US010714326B2

(12) United States Patent
Holman et al.

(10) Patent No.: US 10,714,326 B2
(45) Date of Patent: Jul. 14, 2020

(54) LASER ABLATION SPECTROMETRY SYSTEM

(71) Applicants: Hoi-Ying N. Holman, Oakland, CA (US); Antoine Masson, Lausanne (CH); Evan Williams, Oakland, CA (US)

(72) Inventors: Hoi-Ying N. Holman, Oakland, CA (US); Antoine Masson, Lausanne (CH); Evan Williams, Oakland, CA (US)

(73) Assignee: The Regents of the Unversity of California, Oakland, CA (US)

( * ) Notice: Subject to any disclaimer, the term of this patent is extended or adjusted under 35 U.S.C. 154(b) by 0 days.

(21) Appl. No.: 16/170,434

(22) Filed: Oct. 25, 2018

(65) Prior Publication Data

US 2019/0122878 A1 Apr. 25, 2019

Related U.S. Application Data

(60) Provisional application No. 62/577,024, filed on Oct. 25, 2017.

(51) Int. Cl.

| | |
|---|---|
| ***H01J 49/00*** | (2006.01) |
| ***H01J 49/16*** | (2006.01) |
| ***H01J 49/04*** | (2006.01) |

(52) U.S. Cl.

CPC ..... *H01J 49/164* (2013.01); *H01J 49/0004* (2013.01); *H01J 49/0009* (2013.01); (Continued)

(58) Field of Classification Search

CPC ..... H01J 49/00; H01J 49/02; H01J 49/0404; H01J 49/0418; H01J 49/0459; (Continued)

(56) References Cited

U.S. PATENT DOCUMENTS

| | | | |
|---|---|---|---|
| 9,805,921 | B2 | 10/2017 | O'Brien et al. |
| 9,927,352 | B2 | 3/2018 | Birarda et al. |

(Continued)

OTHER PUBLICATIONS

Park, S.G. and K.K. Murray, Infrared laser ablation sample transfer for on-line liquid chromatography electrospray ionization mass spectrometry. Journal of Mass Spectrometry, 2012. 47(10): p. 1322-1326.

(Continued)

*Primary Examiner* — Jason L McCormack

(57) ABSTRACT

This disclosure provides systems, methods, and apparatus related to laser ablation spectrometry systems. In one aspect, a system comprises a microscope, a laser, a continuous flow probe, and a gas confinement device. The laser is positioned to emit light through an objective lens of the microscope. The continuous flow probe is coupled to a spectrometer. An end of the continuous flow probe is positioned proximate a sample and between the sample and the objective lens. The gas confinement device defines a gas inlet, a chamber, a platform, a wall surrounding the platform, a plurality of vents, and a plurality of channels. Each of the plurality of vents is positioned to direct a gas substantially parallel to the platform, and each of the plurality of vents is defined in the wall. The plurality of channels is operable to provide fluid communication between the chamber and the plurality of vents.

20 Claims, 20 Drawing Sheets

(52) U.S. Cl.
CPC ..... *H01J 49/0422* (2013.01); *H01J 49/0463* (2013.01); *H01J 49/167* (2013.01)

(58) Field of Classification Search
CPC ..... H01J 49/0463; H01J 49/16; H01J 49/161; H01J 49/162; H01J 49/164
USPC ..... 250/281, 282, 288
See application file for complete search history.

(56) References Cited

U.S. PATENT DOCUMENTS

| | | | | |
|---|---|---|---|---|
| 2014/0287953 | A1* | 9/2014 | Gunther | G01N 33/60 506/9 |
| 2017/0004959 | A1* | 1/2017 | O'Brien | H01J 49/167 |
| 2018/0047551 | A1* | 2/2018 | Jones | G01N 33/487 |

OTHER PUBLICATIONS

Park, S.G. and K.K. Murray, Infrared Laser Ablation Sample Transfer for MALDI and Electrospray. Journal of the American Society for Mass Spectrometry, 2011. 22(8): p. 1352-1362.

J.T. O'Brien, E.R. Williams, and H.Y.N. Holman, Ambient Infrared Laser Ablation Mass Spectrometry (AIRLAB-MS) of Live Plant Tissue with Plume Capture by Continuous Flow Solvent Probe. Analytical Chemistry, 87(5):2631-2638, 2015.

Hoi-Ying N Holman, Hans A Bechtel, Zhao Hao, and Micheal C Martin. Synchrotron IR spectromicroscopy: chemistry of living cells. Analytical chemistry, 82(21):8757-65, 2010.

Antoine Masson et al. (2017) Towards Integrating Synchrotron FTIR Microscopy with Mass Spectrometry at the Berkeley Synchrotron Infrared Structural Biology (BSISB) Program, Synchrotron Radiation News, 30:4, 17-23.

* cited by examiner

Gluck
163.23
799.77
815.80
961.95
x8

Potato Havana
163.23
799.77
815.80
961.95
x8

John Williams
163.21
815.80
961.95
x8

TLA
219.16
815.80
x4
100
0
Relative Abundance (%)
200
400
600
800
1000
1200
1400
1600
1800
2000
m/z FIG. 15A
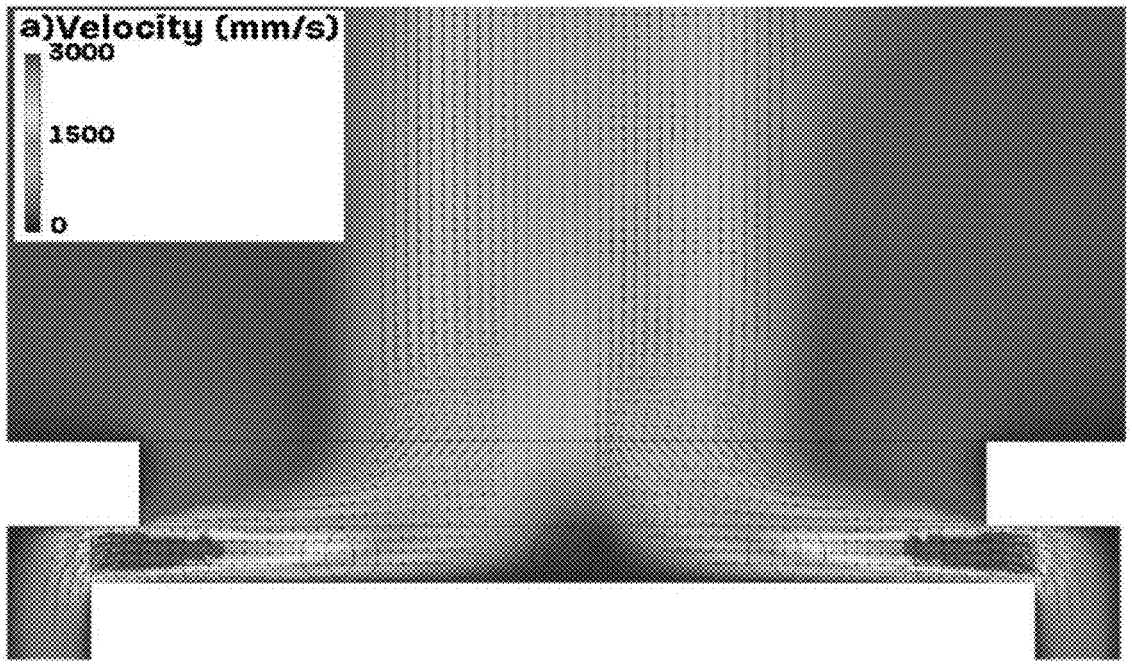
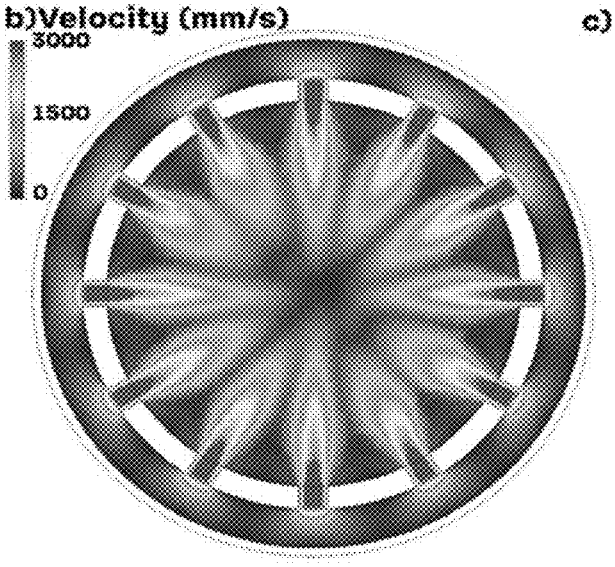
FIG. 15B
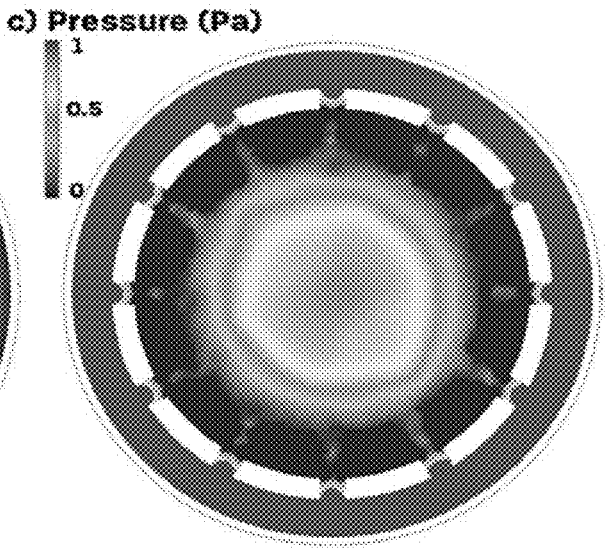
FIG. 15C

LASER ABLATION SPECTROMETRY SYSTEM

RELATED APPLICATIONS

This application claims priority to U.S. Patent Application No. 62/577,024, filed Oct. 25, 2017, which is herein incorporated by reference. This application is related to U.S. Pat. No. 9,805,921, issued Oct. 31, 2017, which is herein incorporated by reference.

STATEMENT OF GOVERNMENT SUPPORT

This invention was made with government support under Contract No. DE-AC02-05CH11231 awarded by the U.S. Department of Energy. The government has certain rights in this invention.

TECHNICAL FIELD

This disclosure relates generally to laser ablation and spectrometry.

BACKGROUND

Determining the chemical composition of complex biological systems, such as tissues, biofilms, and microbial colonies, presents a daunting analytical challenge. The compositions of such samples are typically heterogeneous and dynamic, changing both in time and in response to varying environmental conditions. This necessitates the use of methods of analysis that can provide chemical information with both high spatial and temporal resolution. The ability to measure and image the chemical composition of biological samples under native conditions and with minimal modification/preparation is important to advancing the understanding of processes, such as cell differentiation, photosynthesis, and cellular metabolism during stress-and-adaptive response, and nonenzymatic glycation in cardiac tissues induced by a high glycemic index diet.

There are many microanalysis techniques for characterizing the chemical composition of biological samples, including NMR/MRI, visible microscopy, infrared spectromicroscopy, Raman imaging, fluorescence-tagging and imaging of molecules, and imaging mass spectrometry. Many of these techniques can provide high spatial resolution and are nondestructive, but often do not provide unambiguous chemical information. Fluorescence-tagging of molecules can be used to obtain images with both high spatial resolution (~1-200 nm) and high molecular specificity by using antibodies to target specific molecules. However, only a few components can be imaged simultaneously, and the procedure for tagging molecules with fluorophores often requires extensive sample preparation. Imaging mass spectrometry provides chemical information with excellent molecular specificity, and thousands of compounds can be measured simultaneously. Mass spectrometry can also be combined with other imaging techniques to provide multimodal imaging analysis. Unlike many optical methods, mass spectrometry is a destructive technique; molecules must be removed from the sample and ionized to be detected.

The most widely used mass spectrometry imaging techniques are matrix-assisted laser desorption ionization (MALDI) and secondary ion mass spectrometry (SIMS). Conventional MALDI and SIMS are often used to generate chemical images for fixed tissue samples. For both techniques, ions are generated in vacuum and are subsequently mass analyzed. Because vacuum is required for these techniques, neither is suitable for the analysis of living systems. MALDI typically involves the application of an external and usually denaturing matrix molecule which absorbs the energy from a laser for ablation and ionization. With SIMS, secondary ions are sputtered from a surface with a beam of primary ions, such as $Cs^+$ or polyatomic $Au_n^+$ clusters. Chemical images can be obtained with very high spatial resolution (~100 nm), but the sensitivity for high mass ions (m/z>1000) is often low.

Many techniques for imaging mass spectrometry at ambient pressure have been recently introduced. Cooks and co-workers developed a now widely used method, desorption electrospray ionization (DESI), in 2004. With DESI, charged solvent droplets generated by electrospray are directed toward a sample surface to desorb and ionize the sample at the surface. Many other ambient imaging mass spectrometry techniques have subsequently been developed. With nano-DESI and liquid microjunction surface sampling probe (LMJ-SSP), the solvent contacts a small area of a sample and is then directed to an ESI source. Numerous methods use laser light to select spatially resolved areas for mass analysis. These methods include atmospheric pressure infrared MALDI (AP IR-MALDI), electrospray-assisted laser desorption ionization (ELDI), matrix-assisted laser desorption electrospray ionization (MALDESI), laser ablation electrospray ionization (LAESI), laser ablation capillary electrophoresis electrospray ionization (CE-ESI), and IR, visible light, or near-IR laser ablation sample transfer (LAST).

Methods that use IR-laser ablation can take advantage of the water naturally present in biological samples as a matrix to absorb IR radiation. The IR laser pulse produces surface evaporation, phase explosion (explosive boiling) of water, and the secondary ejection of sample material into a plume of fine droplets. The ejected sample material consists of mostly neutral droplets, particles, or molecules, which can be ionized by intersection with an electrospray plume (ELDI, LAESI, and MALDESI), or can be captured in solvent through LAST for subsequent ionization by electrospray, or for capillary electrophoresis separation prior to subsequent ionization by electrospray. The fraction of ions that are produced directly can be introduced into the mass spectrometer, for example atmospheric pressure infrared MALDI (AP IR-MALDI). Little excess energy is deposited into solute molecules in IR laser ablation. Studies with thermometer ions and peptides show that LAESI produces ions with internal energies indistinguishable from those produced by ESI, indicating that the laser ablation process itself is soft.

High transfer efficiency of the sample to the mass spectrometer is especially important for the analysis of biological samples due to low concentrations of some molecular species within the highly complex mixtures of biochemicals from living cells. The transfer efficiency of laser ablated material from a surface to a solvent probe depends on the instrumental geometry. In experiments where backside laser ablation was used, the transfer efficiency for ablated angiotensin II in solution on a quartz slide to solution on a probe 1 mm away is reported to be 2%. LAESI, in which the ablation plume expands into a flow of highly charged solvent droplets produced by electrospray, is reported to be "characterized by significant sample losses and low ionization efficiencies." Vertes and co-workers reported that the transfer efficiency of LAESI was improved by the use of a capillary to confine the sample and to direct the radial expansion of the ablation plume, guiding more material directly into the electrospray flow.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

SUMMARY

When a biological sample is illuminated by an infrared laser beam, laser absorption by material in surface and near-surface layers leads to temperature rise and surface melting, ablation and plasma formation, and laser-plasma interaction. In the presence of ambient gas, shock waves, plume confinement, and plume condensation all occur, limiting the efficiency of transferring laser-ablated material from samples to a solvent probe. High transfer efficiency of the ablated material to the mass spectrometer is important due to low concentrations of some molecular species within the highly complex mixture of biochemicals within live cells and tissues.

One innovative aspect of the subject matter described in this disclosure can be implemented in a system including a microscope, a laser, a continuous flow probe coupled to a spectrometer, and a gas confinement device. The laser is positioned to emit light through an objective lens of the microscope. An end of the continuous flow probe is positioned proximate a sample and between the sample and the objective lens. The gas confinement device defines a gas inlet, a chamber, a platform, a plurality of vents, and a plurality of channels. The platform is operable to support the sample. Each of the plurality of vents is positioned to direct a gas substantially parallel to the platform. The plurality of channels is operable to provide fluid communication between the chamber and the plurality of vents.

In some implementations, each of the plurality of vents are defined in a wall surrounding the platform. The plurality of vents are symmetrically arranged around the platform, with the symmetrical arrangement being substantially circular.

In some implementations, each of the plurality of vents is positioned about 0.25 millimeters to 0.75 millimeters, or about 0.5 millimeters, above the platform.

In some implementations, each of the plurality of vents comprises an approximately cylindrical vent. In some implementations, a diameter of each of the approximately cylindrical vents is about 0.75 millimeters to 1.25 millimeters, or about 1 millimeter.

In some implementations, the plurality of vents comprises at least 10 vents, or at least 12 vents.

In some implementations, the system further comprises an optical imaging system operable to image a solvent droplet at the end of continuous flow probe. The optical imaging system includes a proportional-integral-derivative feedback system operable to control a size of the solvent droplet. In some implementations, the proportional-integral-derivative feedback system is operable to control a flow rate of a pump that provides solvent to the solvent droplet.

Another innovative aspect of the subject matter described in this disclosure can be implemented in a system including a microscope, a laser, a continuous flow probe coupled to a spectrometer, and a gas confinement device. The laser is positioned to emit light through an objective lens of the microscope. An end of the continuous flow probe is positioned proximate a sample and between the sample and the objective lens. The gas confinement device defines a gas inlet, a chamber, a platform, a wall surrounding the platform, a plurality of vents, and a plurality of channels. The wall defines a first notch and a second notch operable to allow a sample holder to be positioned at a center of the platform. Each of the plurality of vents is positioned to direct a gas substantially parallel to the platform. Each of the plurality of vents is defined in the wall. The plurality of channels is operable to provide fluid communication between the chamber and the plurality of vents.

In some implementations, the plurality of vents are symmetrically arranged around the platform, with the symmetrical arrangement being substantially circular.

In some implementations, the plurality of vents comprises two slits, with a plane of each slit being substantially parallel to the sample platform.

In some implementations, each of the plurality of vents is positioned about 0.25 millimeters to 0.75 millimeters, or about 0.5 millimeters, above the platform.

In some implementations, each of the plurality of vents comprises an approximately cylindrical vent.

In some implementations, the plurality of vents comprises at least 10 vents, or at least 12 vents.

In some implementations, the system further comprises an optical imaging system operable to image a solvent droplet at the end of continuous flow probe. The optical imaging system includes a proportional-integral-derivative feedback system operable to control a size of the solvent droplet. In some implementations, the proportional-integral-derivative feedback system is operable to control a flow rate of a pump that provides solvent to the solvent droplet.

Another innovative aspect of the subject matter described in this disclosure can be implemented in a system including a microscope, a laser, a continuous flow probe coupled to a spectrometer, an optical imaging system operable to image a solvent droplet at the end of continuous flow probe, and a platform operable to hold a sample to be subjected to laser ablation. The laser is positioned to emit light through an objective lens of the microscope. An end of the continuous flow probe is positioned proximate a sample and between the sample and the objective lens. The optical imaging system includes a proportional-integral-derivative feedback system operable to control a size of the solvent droplet.

In some implementations, the optical imaging system includes an imaging laser and a camera.

In some implementations, the proportional-integral-derivative feedback system is operable to control a flow rate of a pump that provides solvent to the solvent droplet. In some implementations, the pump comprises a syringe pump.

In some implementations of the systems described herein, the continuous flow probe is coupled to an electrospray ionization emitter of the spectrometer. In some implementations, the continuous flow probe is coupled to a capillary electrophoresis (CE) capillary that is coupled to an electrospray ionization (ESI) emitter of the spectrometer.

In some implementations of the systems described herein, the continuous flow probe comprises an outer capillary and an inner capillary. The outer capillary is open and notched at the end of the continuous flow probe to allow the solvent drop to be exposed to capture the sample ablated by the laser.

In some implementations of the systems described herein, the microscope comprises an infrared microscope and the laser comprises an infrared laser. In some implementations of the systems described herein, the microscope comprises an infrared microscope and the laser comprises a non-infrared laser (e.g., a near-infrared or VIS laser). In some implementations of the systems described herein, the spectrometer comprises a mass spectrometer.

In some implementations of the systems described herein, the laser is operable to emit visible light. In some implementations, the laser is operable to emit infrared light. In some implementations, the infrared laser is operable to emit light of about 2.7 microns to 3.1 microns, about 3.0 microns to 3.45 microns, or about 2.94 microns.

In some implementations of the systems described herein, the microscope includes an infrared reflective objective. The reflective objective is operable to focus light emitted from the infrared laser onto the sample.

In some implementations of the systems described herein, the microscope includes an infinity-corrected reflective objective. The infinity-corrected reflective objective is operable to focus light emitted from the laser onto the sample. The infinity-corrected reflective objective can allow for a longer working distance for examining larger areas.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

FIG. 11A—Glurk; FIG. 11B—Petite Havana; FIG. 11C—John Williams; and FIG. 11D—truncated light antenna (TLA), a mutant variety based on the John Williams wild-type.

FIGS. 15A-15C show the results of gas dynamics modeling of nitrogen gas at the output of the gas confinement device with an inlet flow of 75 L/h. FIG. 15A shows an example of a velocity contour plot of the vertical midplane where the vectors represent the gas flow trajectory. Only the sample region is shown. FIG. 15B shows an example of a velocity contour plot at the midplane of the output holes (height=0.5 mm from the sample holder). FIG. 15C shows an example of a static pressure contour plot of a plane located on top of a hypothetical sample of 0.3 mm height. The representation of the pressure inside the device is deliberately saturated in order to have enough contrast to represent the outside.

DETAILED DESCRIPTION

Figure 1A:
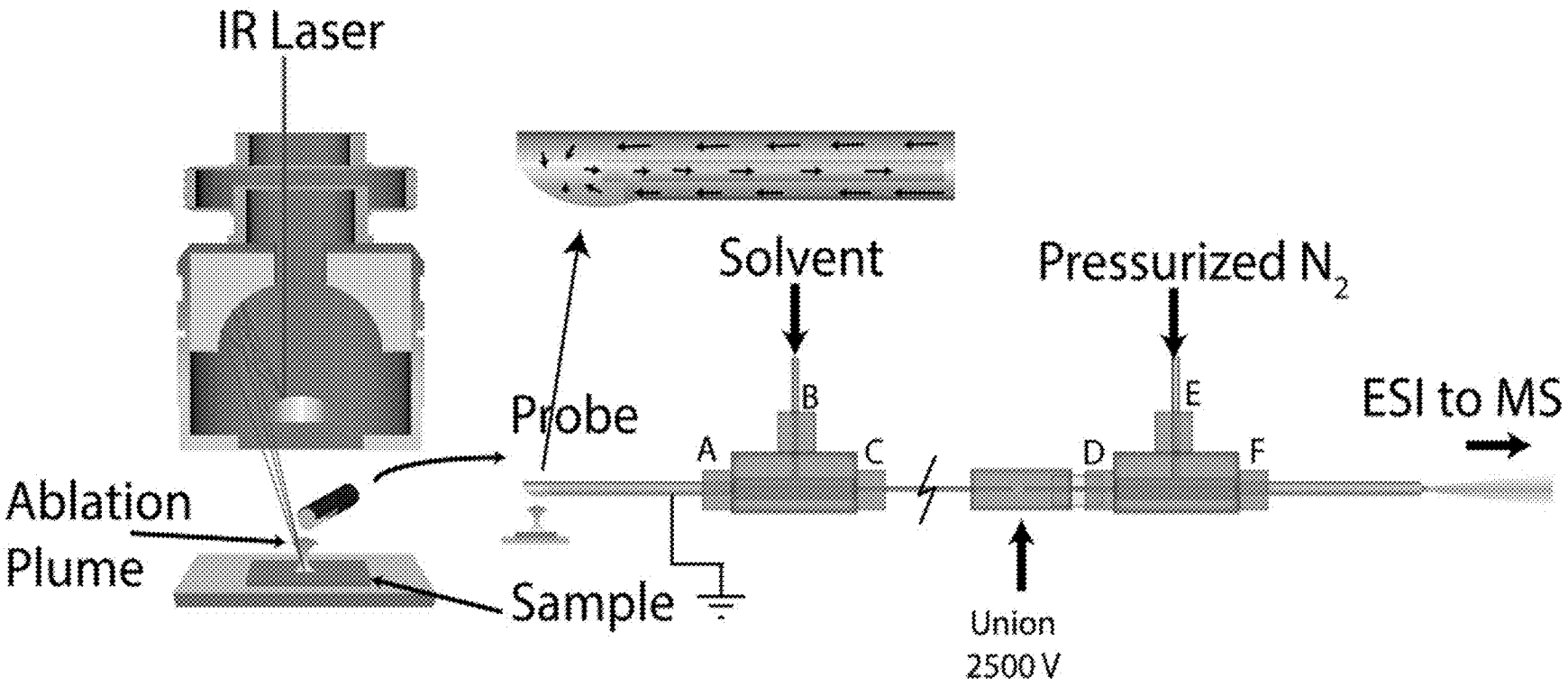
FIG. 1A shows an example of a schematic illustration of an AIRLAB-MS system.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a value is close to a targeted value, where close can mean, for example, the value is within 80% of the targeted value, within 85% of the targeted value, within 90% of the targeted value, within 95% of the targeted value, or within 99% of the targeted value.

Ambient mass spectrometry (MS) imaging of live cells under ambient conditions can provide insight into biological processes such as cell differentiation and photosynthesis. Imaging MS techniques that use IR laser ablation take advantage of the water naturally present in biological samples as a matrix to absorb IR radiation. Explosive boiling of the water ejects sample material into a plume of fine droplets. These mostly neutral droplets can be ionized by intersection with an electrospray plume or captured in solvent for ionization by electrospray. High transfer efficiency is important for the analysis of biological samples due to low concentrations of some molecular species, but existing techniques report low (~2%) transfer efficiency and significant sample losses and low ionization efficiencies. Embodiments described herein overcome these issues and can have a transfer efficiency of ~50% to 100%.

Described herein is a system for ambient infrared (IR) laser ablation mass spectrometry (AIRLAB-MS). In some embodiments, the system comprises a laser, an infrared microscope with a reflecting objective, and a continuous flow probe coupled to a mass spectrometer and/or mass analyzer. In some embodiments, the system has the advantage of high transfer efficiency (~50% to 100%) and can provide measurements with high reproducibility from samples, such as biological materials, with a standard deviation of less than about 10%.

Figure 1B:
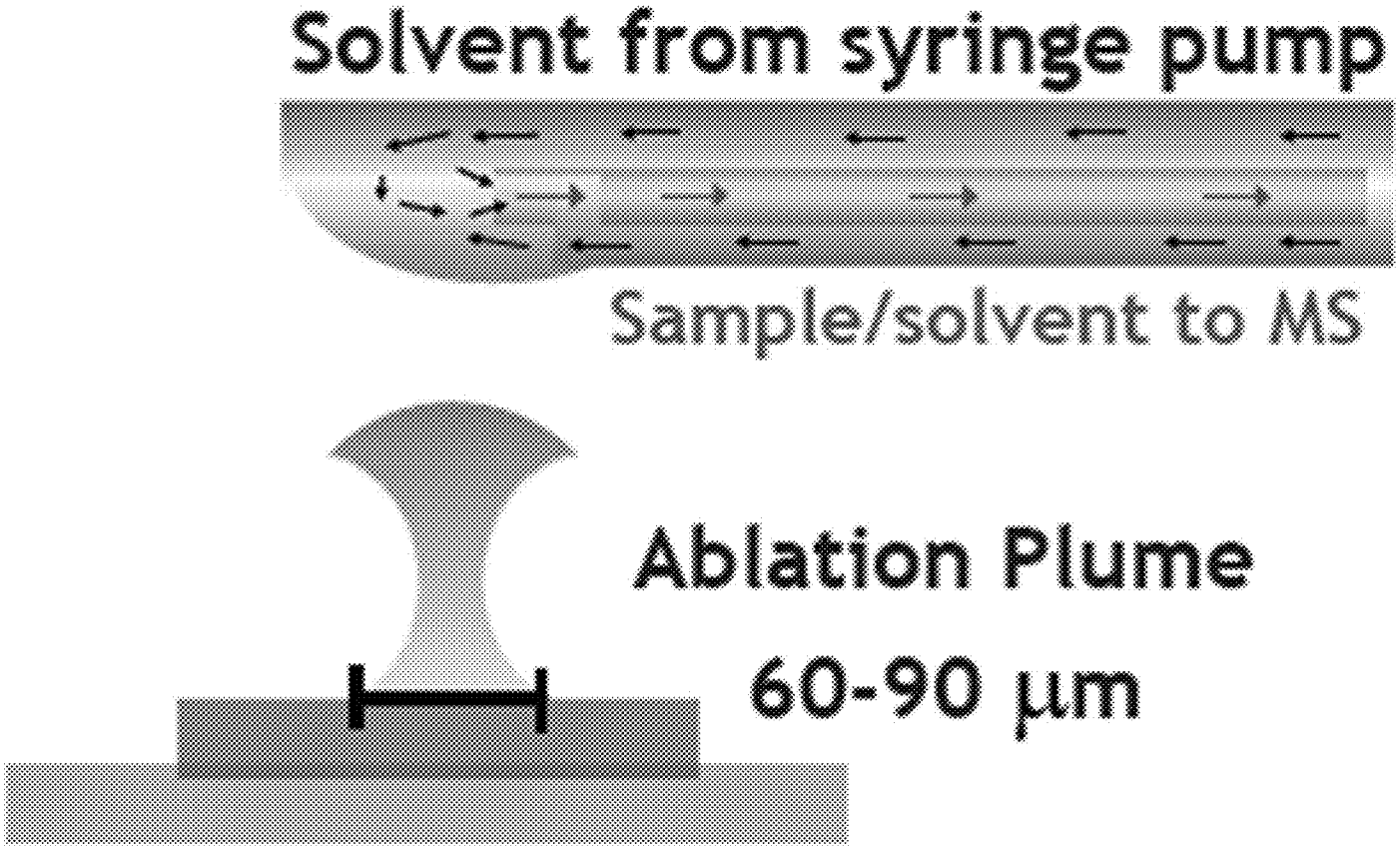
FIG. 1B shows an example of a schematic illustration of a continuous flow probe and a sample ablation plume.

FIG. 1A shows an example of a schematic illustration of an AIRLAB-MS system. FIG. 1B shows an example of a schematic illustration of a continuous flow probe and a sample ablation plume.

As shown in FIG. 1A, an infrared (IR) laser is focused through a reflecting objective (e.g., 15×) mounted on an infrared microscope. The laser beam impinges the sample. The ablation plume generated is captured by a solvent droplet at the tip of continuous flow probe (e.g., a stainless steel capillary attached to a tee fitting (e.g., a PEEK tee fitting, port A)). Solvent is pumped with a pump (e.g., a syringe pump) into port B. A capillary (e.g., a fused silica capillary) carries solvent and ablated material from the continuous flow probe tip (enlarged to show solvent flow in FIG. 1B) out through port C and to an electrospray emitter. A union (e.g., stainless steel, attached to port D) is used to apply the electrospray voltage to the solution. Regulated $N_2$ enters the emitter tee fitting at port E and a capillary (e.g., a fused silica capillary) carries solvent and sample from the union, through the tee, and out port F where ions are generated by pneumatically assisted electrospray ionization.

The laser may comprise any pulsed IR laser that is tuned to absorption bound water such that any location where the laser is focused and any sample that includes water is vaporized upon laser emittance, after which the sample is ablated and expelled upward in a plume. In some embodiments, the IR laser emits 2.94 μm light, which corresponds to the peak of water absorption. In some embodiments, the laser spot size is about 60 μm, which corresponds to an energy density of about 5.3 J/cm$^2$.

The continuous flow probe is assembled and fitted to connect to the electrospray emitter. In some embodiments, the continuous flow probe comprises an outer capillary and an inner capillary assembled in a manner such that solvent from a pump is continuously flowed to the tip of the probe in the outer capillary. The ablated sample plume can be captured by the inner capillary to transfer the ablated sample to the mass spectrometry emitter. In some embodiments, the outer capillary is notched at the tip of the probe (See FIGS. 1A and 1B) to allow a solvent drop to be exposed to capture ablated sample. The configuration of the end of the continuous flow probe also affects the size and shape of the solvent droplet at the end of the continuous flow probe.

In some embodiments, the continuous flow probe is assembled and fitted to connect to a capillary electrophoresis (CE) capillary that subsequently is coupled to an electrospray ionization (ESI) emitter.

In some embodiments, the reflecting objective comprises an infinity-corrected reflective objective. Such an objective allows the laser to be focused directly under the droplet at the end of the continuous flow probe.

In some embodiments, the continuous flow probe is positioned above the sample. In some embodiments, the continuous flow probe is positioned about 1 mm to 5 mm, about 2 mm to 4 mm, or about 2 mm above the sample.

The solvent flow rate is adjusted to match the electrospray flow rate by observing changes in the size of the solvent droplet at the tip of the continuous flow probe. In some embodiments, a small droplet (e.g., about 0.6 mm radius) is maintained at the tip of the probe until laser ablation occurs. Directly after a laser ablation event, the flow is stopped until the droplet is aspirated into the capillary, which may take a few seconds (e.g., about 4 s to 8 s) to minimize dilution of the sample. Afterwards, the solvent flow rate is subsequently increased until another small droplet is formed.

In some embodiments, the continuous flow probe is further connected through a multi-port or T-shaped connector to a syringe pump and typically operated at flow rates of about 20 μL/min to 30 μL/min. In some embodiments, the continuous flow probe comprises a fused silica capillary having an outer and inner diameter that extends through the T-shaped connector and into the stainless steel capillary up to the notch and the other end exits the probe and attached to the electrospray emitter. In some embodiments, the outer capillary comprises stainless steel or other metal, and the inner capillary comprises fused silica.

In some embodiments, the system further comprises methods embodied in computer-generated and/or computer-controlled scripts which combine and automate the position of the stage operable to hold the sample and on/off control of the laser. In some embodiments, the pump for solvent flow is controlled. In some embodiments, the pump for solvent flow is controlled manually or control is automated by an actuator or using computer control.

In some embodiments, the sample is subjected to laser ablation to create a discrete plume of fine droplets which are collected through the continuous flow probe and transferred to a mass analyzer or mass spectrometer. Mass spectra can be collected using a mass spectrometer and analyzed using any means of mass spectrometry and/or ion mobility analysis known in the art.

In some embodiments, the continuous flow probe directs the captured sample molecules into a mass analyzer or detector. Such a mass analyzer or detector may comprise a time-of-flight (TOF), a quadrupole ion trap or linear trap, an Orbitrap, a Fourier-transform ion cyclotron resonance (FT-ICR), a magnetic sector, a quadrupole, or other mass spectrometer and/or ion mobility spectrometer. In some embodiments, the ions that result either from direct desorption/ionization or subsequent ionization/fragmentation processing of the sample are analyzed to separate or measure the mass to charge ratio of the ions and the abundance of these ions. There are a wide range of mass analyzers that can be used. Such instruments include time-of-flight (TOF), quadrupole ion trap or linear trap, Orbitrap, Fourier-transform ion cyclotron resonance (FT-ICR), magnetic sector, quadrupole, or other mass analyzers and combinations of mass analyzers and ion mobility spectrometers. In some embodiments, FT-ICR and tandem mass spectrometers (MS/MS) are used.

In some embodiments, visible microscopy, IR spectromicroscopy, and spatially resolved mass spectrometry are integrated into the system. In some embodiments, the system further comprises detectors and an additional light source for conducting visible and/or infrared spectromicroscopy. In some embodiments, the light source emits in the mid-infrared range. In some embodiments, the detector detects infrared reflectance or transmitted light.

In some embodiments, prior to laser ablation of the sample, IR spectromicroscopy and/or visible microscopy is conducted on the sample area. In some embodiments, IR reflectance spectroscopy can be conducted.

The systems and methods described herein for ambient infrared (IR) laser ablation mass spectrometry (AIRLAB-MS) may be carried out on any biological or other sample where the water content of the sample may be used as a matrix to absorb IR radiation for ablation of the sample. In some embodiments, the sample can be a biological material, including but not limited to organic matter or samples, plant materials including leaves, stem, roots, or petals, etc., and including organism tissue or materials from microbial organisms and communities, prokaryiotic or eukaryotic organisms, tissue samples, cells, matrix, or metabolites, etc.

The systems and methods described herein for AIRLAB-MS may not require sample preparation. The application of AIRLAB-MS to tobacco leaf samples is described in the EXAMPLES below. Spatially resolved mass spectra for the leaves of a genetically modified tobacco plant variety and its corresponding wild-type were measured and the spatial distribution of nicotine was compared for selected leaf areas.

Additional features of the AIRLAB-MS system are described below. One goal of these features is to increase the efficiency of transferring laser-ablated material from biological samples to the continuous flow probe (e.g., a hanging solvent droplet at the notch tip). These additional features include: (1) a module with a proportional-integral-derivative (PID) feedback loop that enables measurement and automated control of the dimension/size of the solvent droplet at the tip of the continuous flow probe; (2) a gas confinement device operable to generate a three dimensional (3D) laminar gas flow field to contain the horizontal expansion of the laser ablation plume while pushing the plume upward into the solvent droplet; and (3) a module operable to adjust the distance between the surface of the solvent droplet and the stage. In some embodiments, these additional features enable near 100% efficiency of the AIRLAB-MS system.

Figure 2:
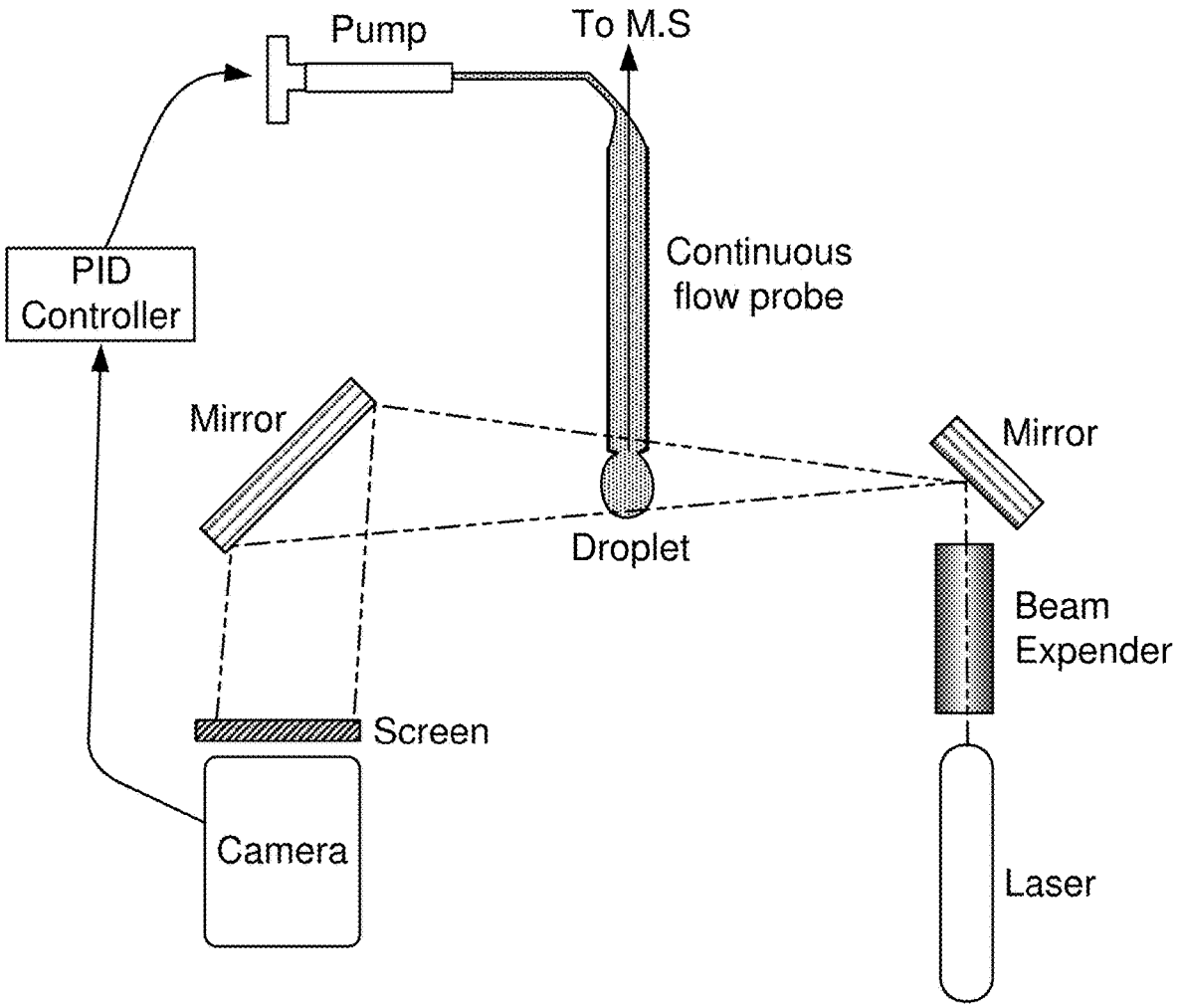
FIG. 2 shows an example of a schematic illustration of an optical imaging system for the solvent droplet at an end of the continuous flow probe.

FIG. 2 shows an example of a schematic illustration of an optical imaging system for the solvent droplet at an end of the continuous flow probe. The optical imaging system includes a feedback system (e.g., a proportional-integral-derivative (PID) control system) to measure and control the dimension/size of the hanging solvent droplet. In the optical imaging system shown in FIG. 2, a laser beam (e.g., a low-power red (i.e., about 635 nm to 660 nm) laser diode beam) is expanded by a beam expender, re-directed by a mirror, and passes through the hanging solvent droplet. The resulting light continues to pass through a screen (e.g., a semi-transparent screen) before being recorded by a camera. In some embodiments, the light is recorded in real time using a webcam with a universal serial bus (USB) connection to the computer.

In some embodiments, the solvent droplet image is isolated by background subtraction. In some embodiments, the number of pixels in the solvent droplet image is used to determine the droplet size. For example, solvent droplet size can be calibrated using the known size of the metal capillary from which the solvent droplet is suspended. The solvent droplet size measurement is used in a closed loop feedback control (e.g., a proportional-integral-derivative (PID) control) to control the flow rate of the pump (e.g., a syringe pump) that provides solvent to the droplet. In some embodiments, the feedback system operates at a rate of about 2 Hz. This can make possible control of the solvent droplet size with a precision of about ±0.1 mm. In some embodiments, the diameter of the solvent droplet it about 1 mm to 1.8 mm, or about 1.4 mm.

The PID control can be implemented in different ways. For example, in some embodiments, the PID control is performed using a computer system. In some embodiments, the PID control is implemented using a PID controller.

In some embodiments, the PID control is in communication with a control of the laser. In some embodiments, when performing an experiment, the PID control stops flow of the solvent in the continuous flow probe when the solvent droplet reaches a specified size, the laser ablates the sample, and then the PID control resumes flow of the solvent in the continuous flow probe. This method can aid in obtaining an undiluted ablation sample for the mass spectrometer.

Figure 3:
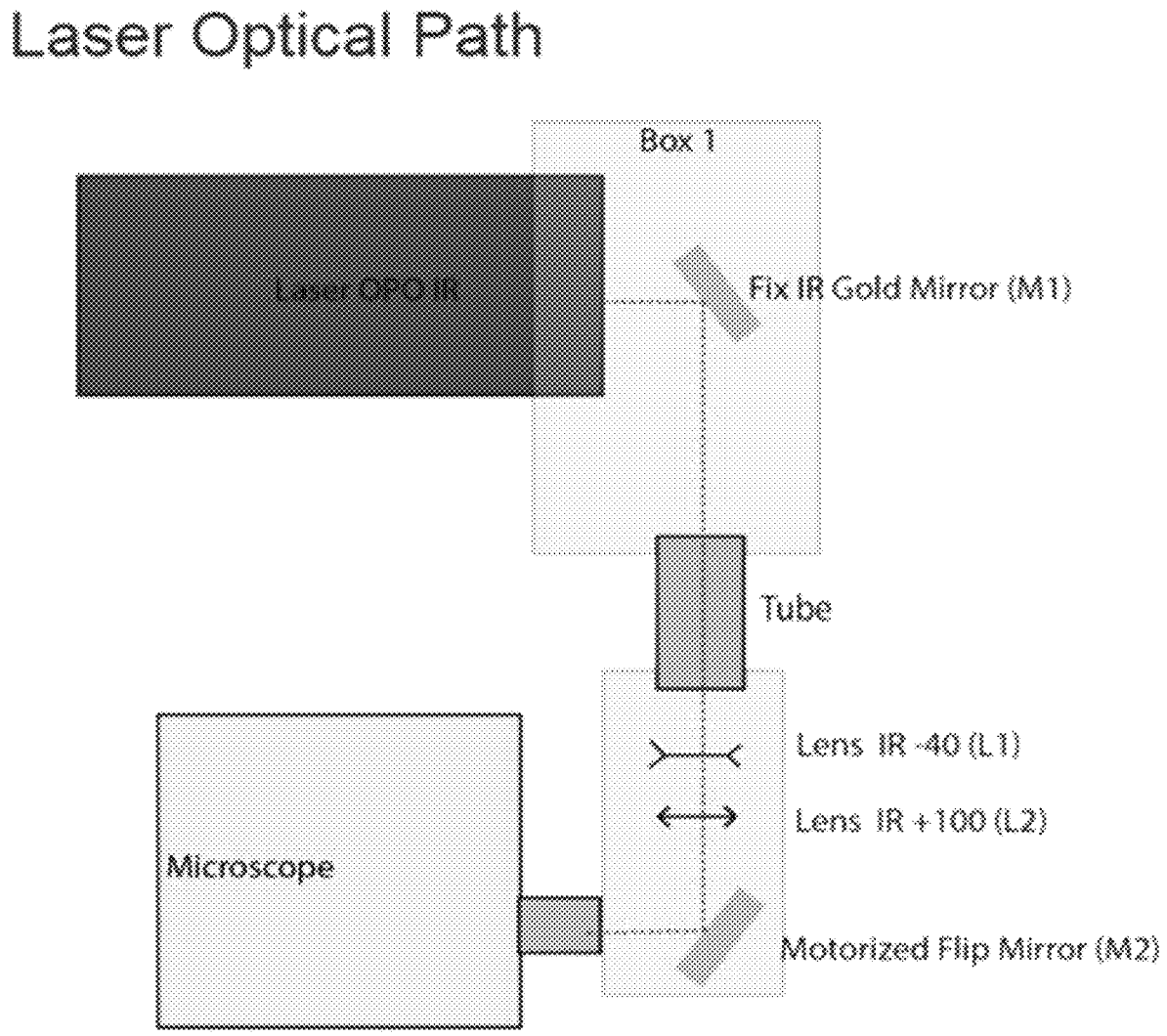
FIG. 3 shows an example of a schematic illustration of a system operable to improve the power and the quality of the laser beam emitted from the laser.

FIG. 3 shows an example of a schematic illustration of a system operable to improve the power and the quality of the laser beam emitted from the laser.

A gas confinement device is operable to generate a 3D laminar gas flow field to aid in confining the laser ablation plume while pushing the plume upward to the hanging solvent droplet. This serves to enhance the transfer of material ablated from the surface of a sample to the solvent droplet hanging from the continuous flow probe. The gas confinement device confines the ablation plume generated by the laser using a gas (e.g., nitrogen ($N_2$) gas or dry $N_2$ gas) that flows through holes surrounding the sample. In some embodiments, the gas confinement device includes 10 or more or 12 or more vents or holes. The gas flow, initially perpendicular to the plume, results in a higher pressure region above the sample that directs the ablation products toward the solvent droplet and confines them to roughly a region corresponding to the droplet diameter.

Figure 4:
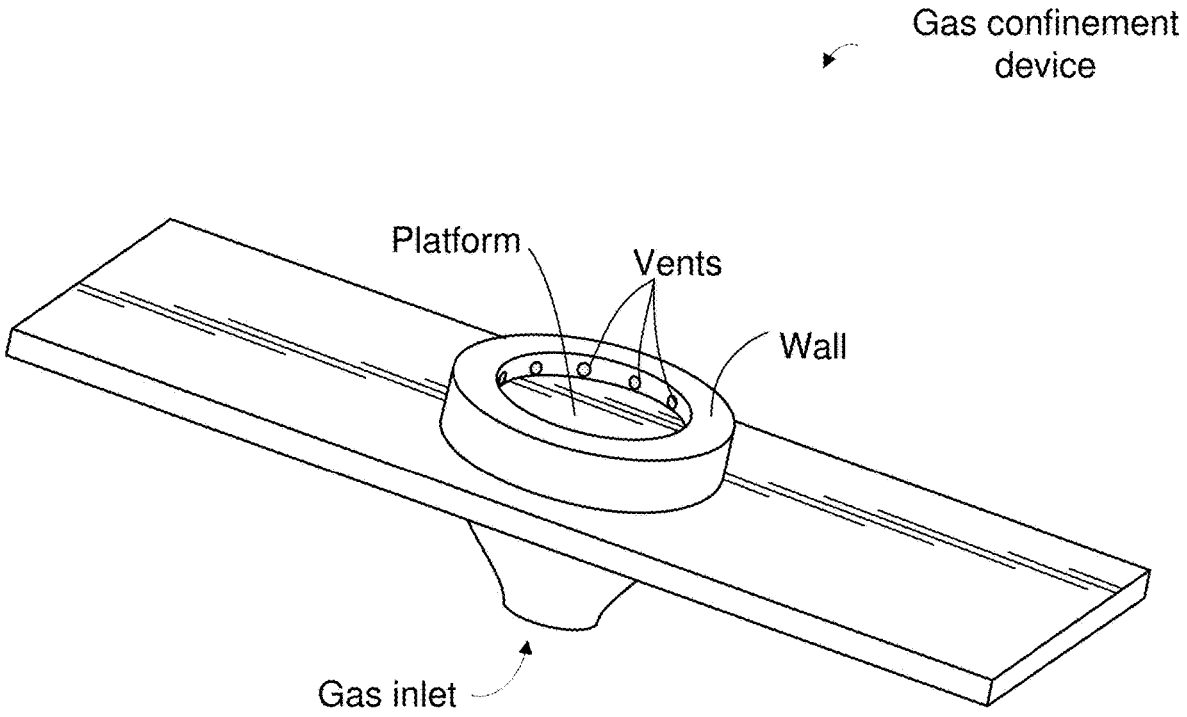
FIG. 4 shows an example of a schematic illustration of a gas confinement device.
Figure 5:
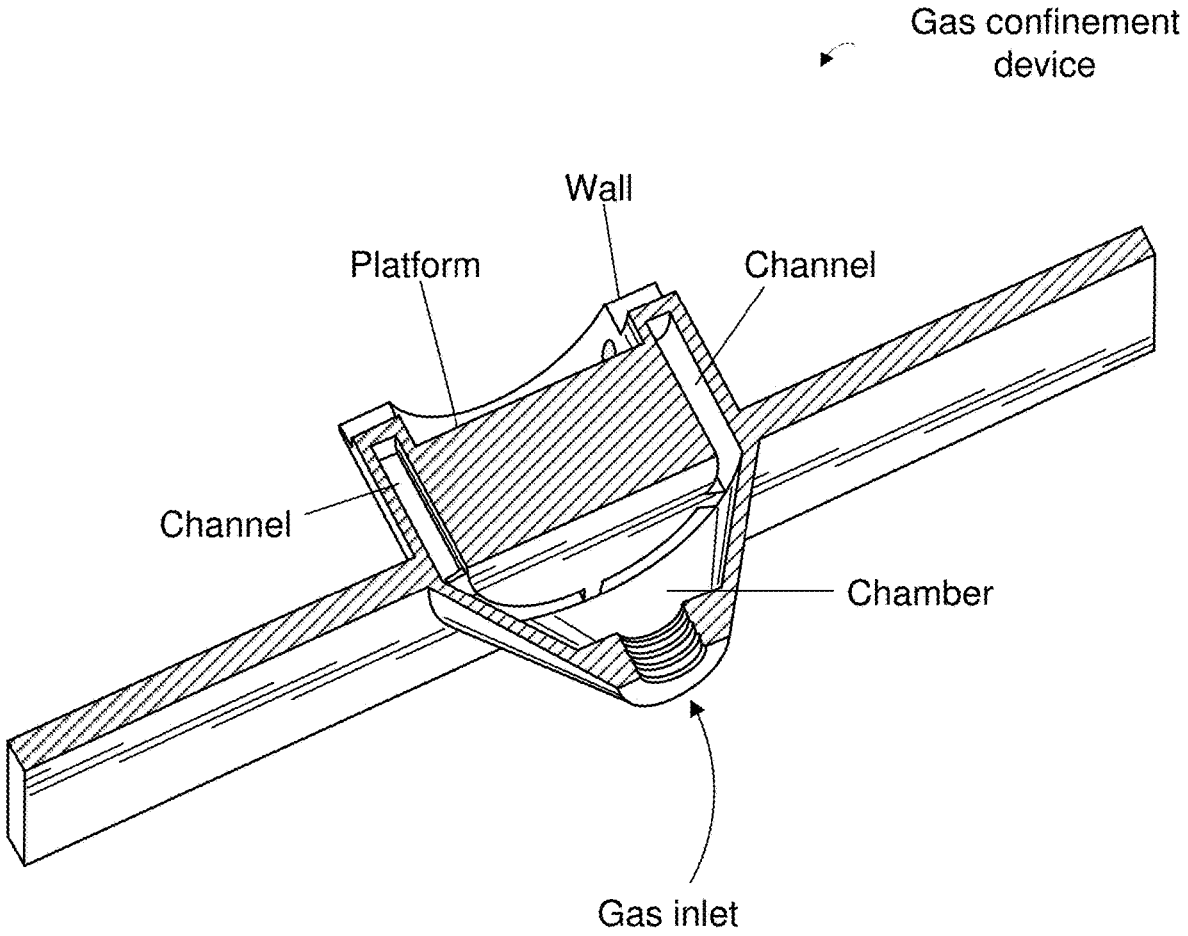
FIG. 5 shows an example of a cross-sectional schematic illustration of a gas confinement device.
Figure 6:
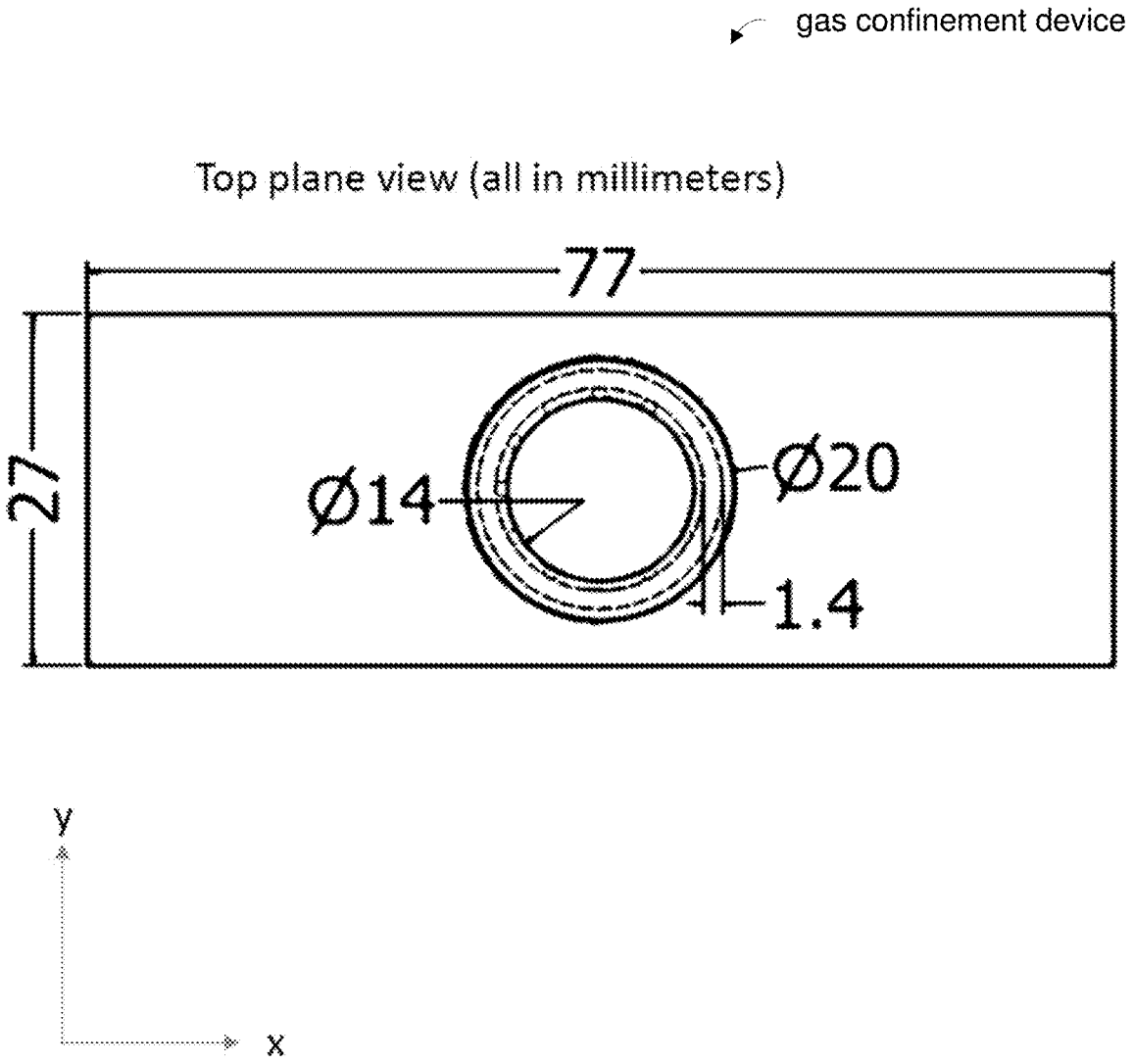
FIG. 6 shows an example of a top view of a gas confinement device.
Figure 7:
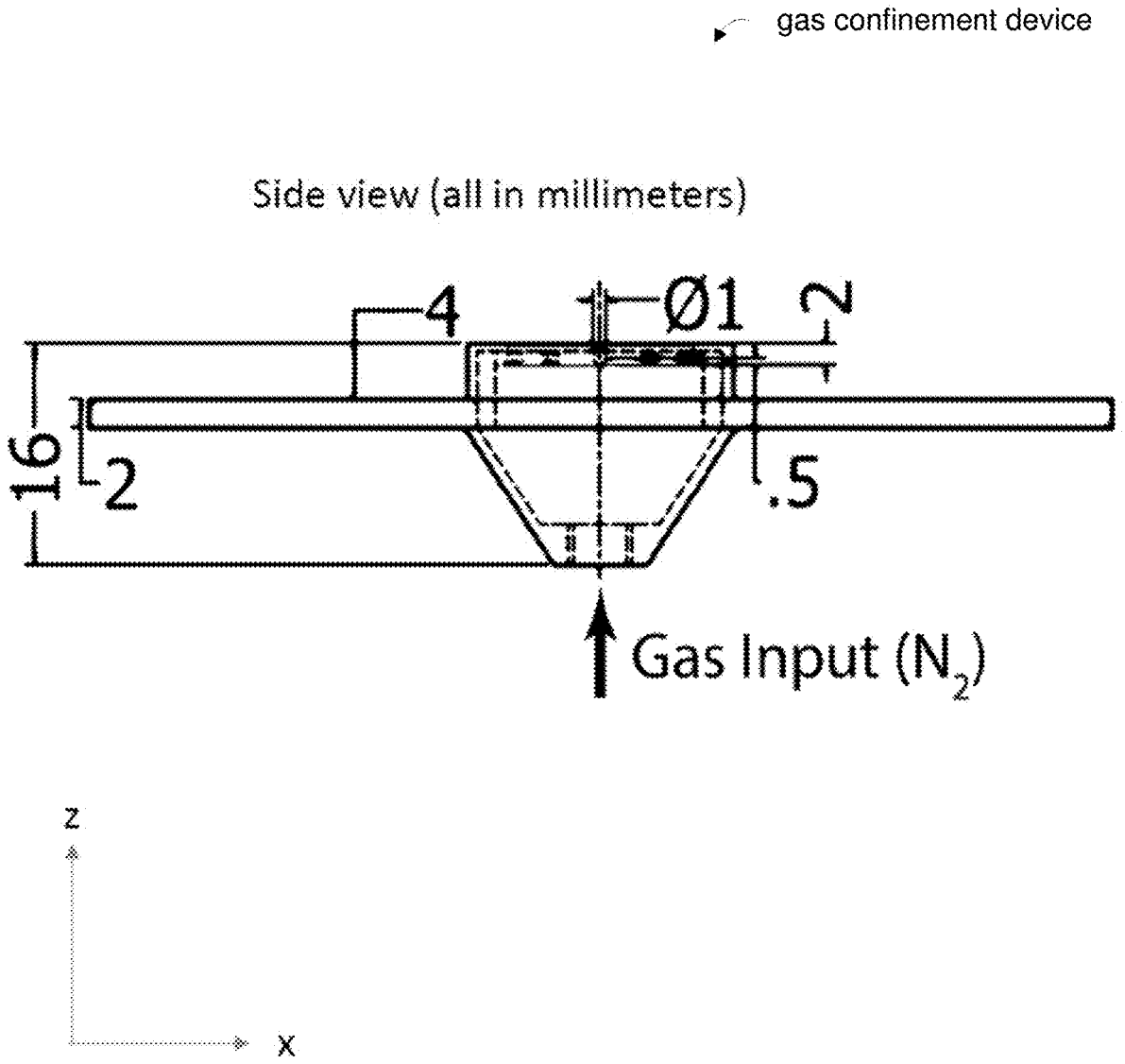
FIG. 7 shows an example of a plane view of a gas confinement device.

FIG. 4 shows an example of a schematic illustration of a gas confinement device. FIG. 5 shows an example of a cross-sectional schematic illustration of a gas confinement device. FIG. 6 shows an example of a top view of a gas confinement device. FIG. 7 shows an example of a plane view of a gas confinement device.

The gas confinement device shown in FIGS. 4-7 defines a gas inlet, a chamber, a platform, a plurality of vents, and a plurality of channels. The platform is operable to support a sample. Each of the plurality of vents is positioned to direct a gas substantially parallel to the platform. The plurality of channels are operable to provide fluid communication between the chamber and the plurality of vents. The gas confinement device shown in FIG. 4-7 serves as a sample holder for the AIRLAB-MS system.

When in operation, gas enters the gas confinement device through the gas inlet. The gas expands to fill the chamber. The chamber serves in part to make the flow and the pressure of the gas uniform so that the amount and velocity of the gas flowing out of each of the plurality of vents is substantially the same.

One challenge of the gas confinement device shown in FIGS. 4-7 is associated with the alignment of the center zone of the hanging solvent droplet, the center zone of the gas confinement device, and the location of ablation. For the gas confinement device shown in FIGS. 4-7, the configuration is such that the sample is held within the gas confinement device on a platform. This simplifies the design and construction of the gas confinement device. However, a sample being held or resting on a platform of the gas confinement device has the disadvantage that during space-resolved measurements, the points of ablation are not necessary at the center of the gas confinement device, and the above-described three-point alignment no longer holds. This leads to a decrease in material transfer efficiency. To improve the material transfer efficiency, the entire gas confinement device needs to be moved and re-centered on an x-y translation stage. The continuous flow probe must also be moved to optimize signal.

Figure 8:
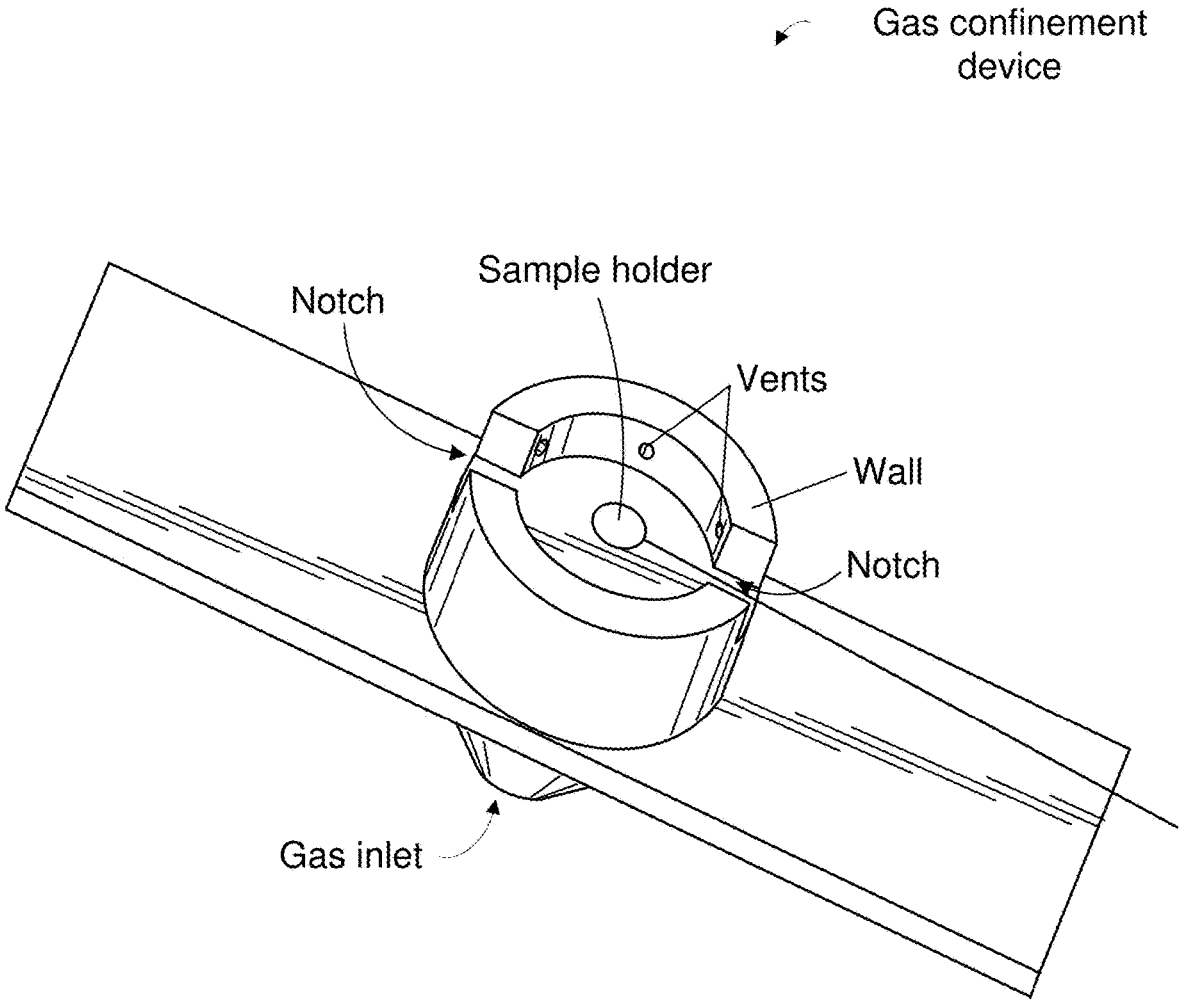
FIG. 8 shows an example of a cross-sectional schematic illustration of a gas confinement device.
Figure 9:
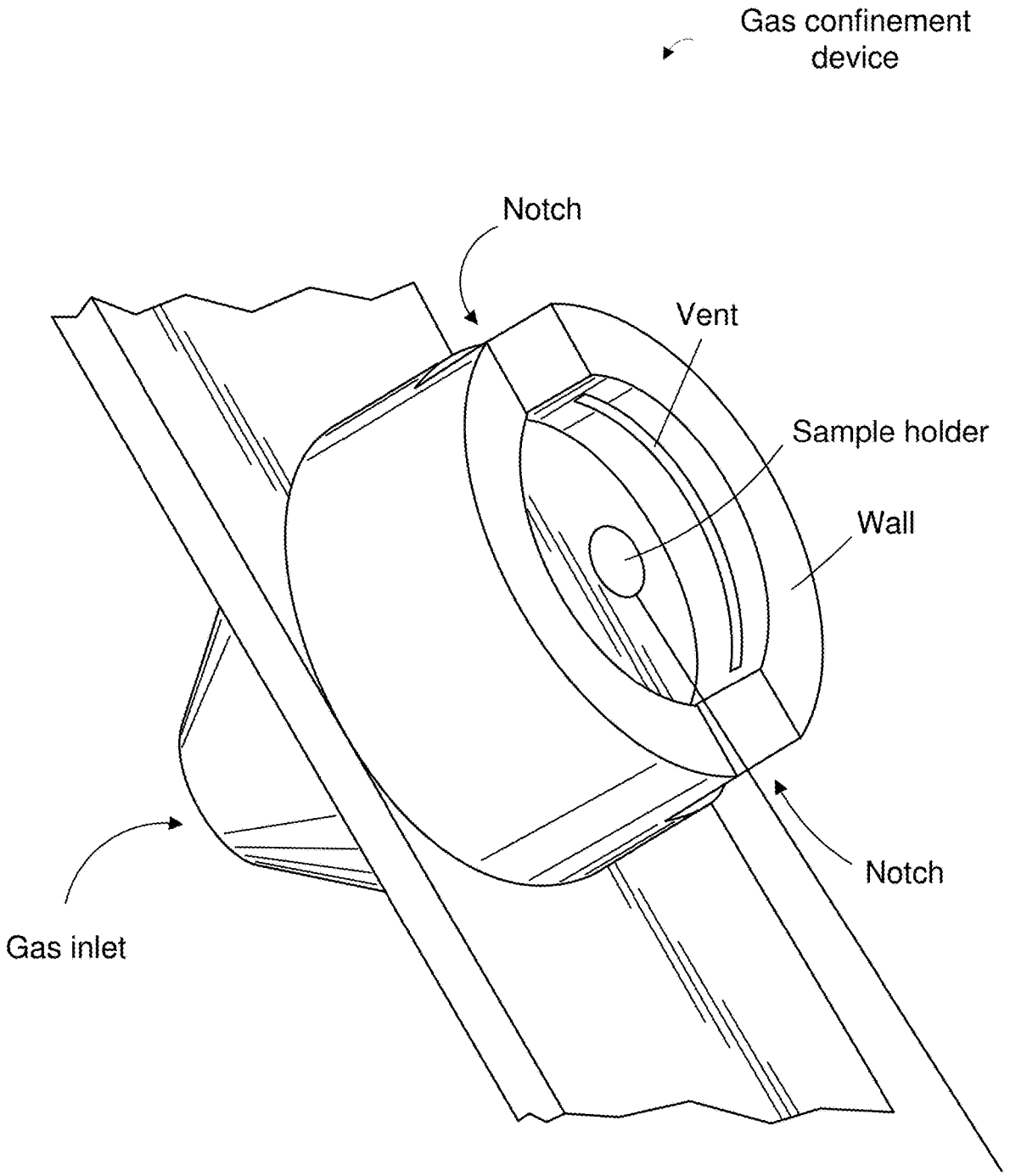
FIG. 9 shows an example of a cross-sectional schematic illustration of a gas confinement device.

FIG. 8 shows an example of a cross-sectional schematic illustration of a gas confinement device. FIG. 9 shows an example of a cross-sectional schematic illustration of a gas confinement device. In the gas confinement devices shown in FIGS. 8 and 9, the walls surrounding the platform include a first notch and a second notch operable to allow a sample holder to be positioned at a center of the platform. The sample holder is not attached to or part of the gas confinement device. Thus, with the gas confinement devices shown in FIGS. 8 and 9, the center zone of the gas confinement device can remain stationary relative to the hanging solvent droplet and independent of x-y translation of a sample holder. When the sample holder is moved, the ablation plume remains aligned with respect to the center zone of the gaseous confinement and the hanging solvent droplet.

AIRLAB mass spectrometry with FTIR spectral microscopy can also be integrated in a single multi-modal imaging platform. The platform includes: (1) an infrared microscope shared by both AIRLAB MS and the FTIR Spectral microscopy; (2) a set of computer controlled mirrors and relevant IR optics; and (3) a software package. For example, an FTIR system and an AIRLAB-MS system can share a single infrared microscope and sample stage through a set of computer-controlled switch mirrors.

The following examples are intended to be examples of the embodiments disclosed herein, and are not intended to be limiting.

FIRST SET OF EXAMPLES

Example—Airlab Mass Spectrometry System

The AIRLAB mass spectrometry system used to perform the experiments described in the EXAMPLES below is described below.

The ambient infrared laser ablation mass spectrometry (AIRLAB-MS) instrumentation comprised four main components: an Opolette tunable (2.7 μm-3.1 μm) infrared laser (Opotek, Carlsbad, Calif.), a Continuum XL infrared microscope (Thermo-Fisher, Waltham, Mass.) with a reflecting objective, a custom-made continuous flow probe combined with an electrospray ionization (ESI) emitter, or combined with a coupled CE-ESI (capillary electrophoresis-electrospray ionization) emitter, and a mass spectrometer (a custom-made 7 T FT/ICR or a Q-TOF Mass spectrometer (Waters Synapt HDMS, Milford, Mass.)).

The infrared microscope was equipped with a 15× reflecting objective which was used to focus 2.94 μm light from the IR laser. The power of the laser at the sample stage was 12 mW, measured over 30 s with a pulse repetition rate of 20 Hz. The laser spot, estimated from burn marks on photographic paper, was circular with a diameter of ~60 μm, corresponding to an energy density of 5.3 J/cm$^2$ per laser pulse. Samples for laser ablation were typically affixed with double-sided tape to glass microscope slides. The sample position was controlled by a motorized x, y, z translational stage and the sample could be imaged with a visible-light camera. Both the stage and camera were controlled by the Omnic (Thermo-Scientific, Waltham, Mass.) software package. Matlab (Mathworks, Natick, Mass.) scripts were used to combine and automate control of the sample position and on/off control of the laser.

The continuous flow probe was assembled on a PEEK tee fitting (ports A, B, C). A 1/16" outer stainless steel capillary was connected to port A. This capillary was 8.25 cm long and was notched 0.8 mm deep and 1 mm long at the tip of the probe. Port B was connected to a syringe pump (Harvard Appartus, Holliston, Mass.), typically operated at flow rates of 20-30 μL/min. A 250 μm OD, 150 μm ID fused silica capillary extends through the tee and into the stainless steel capillary up to the notch and the other end exits the probe at port C and was attached to the ESI emitter.

The ESI emitter comprises a stainless steel union and a second PEEK tee fitting (ports D, E, F). The union connected the fused silica capillaries (same OD/ID) of the continuous flow probe and the ESI emitter. An electrospray voltage of ~2500 V relative to the entrance capillary of the ESI interface of the mass spectrometer was applied to the stainless steel union which was in contact with the solution. A copper grounding line was connected from the probe capillary to instrument ground in order to prevent buildup of charge at the exposed liquid surface of the probe. Sample and solvent entered the tee at port D inside a fused silica capillary which went through a 750 μm OD, 500 μm ID stainless steel capillary attached to port F and ended 0.5 mm beyond the end of the stainless steel capillary. Port E was connected to a regulated flow of $N_2$ gas, typically maintained at 36 PSI. The pneumatically-assisted electrospray capillary was positioned approximately 1 cm away from the entrance capillary of the mass spectrometer and at an angle of ~30° from perpendicular to the capillary axis.

The position of the probe was controlled by manual x, y, z stages and was set so that the center of the probe notch was positioned directly above the laser focus as visualized with a HeNe laser that was co-linear with the infrared beam. The syringe pump flow rate was adjusted to match the electrospray flow rate by observing any changes in the size of the solvent droplet at the tip of the probe. A small droplet (~0.6 mm radius) was maintained at the tip of the probe until laser ablation occurred. Directly after a laser ablation event, the syringe pump was stopped until the droplet was aspirated into the fused silica capillary (4 s-8 s) to help minimize dilution of the sample. The solvent flow rate was subsequently increased until another small droplet is formed.

The FT/ICR mass spectrometer was based on a 2.75 T described in detail previously in Bush, M. F., et al., Infrared spectroscopy of cationized arginine in the gas phase: Direct evidence for the transition from nonzwitterionic to zwitterionic structure. J. Am. Chem. Soc. 2007, 129, 1612-1622, hereby incorporated by reference, but with a higher field 7 T magnet and a modified vacuum chamber. Briefly, positive ions are generated by electrospray and are guided through five stages of differential pumping to an ion cell. Ions are accumulated for 6 s and a pulse of dry nitrogen gas (~$10^{-6}$ Torr) is used to enhance ion trapping. After a 7 s delay, the ion cell pressure returns to <$10^{-8}$ Torr before ion excitation and detection. During ablation experiments, mass spectra were acquired every 16 s and stored individually. The reported ion abundances are relative to the abundance measured for leucine enkephalin which was included in the solvent flow solution at a concentration of 2.5 μM. Using leucine enkephalin as an internal standard helps minimize effects of any differences in electrospray conditions or solvent flow rate, and enables more comparable measurements of ion abundances for experiments performed on different samples/days.

Example—Solvent Extraction of Tobacco Plants and Analysis

Samples from four tobacco (*Nicotiana tabacum*) plant varieties, Petite Havana (PH), John Williams (JW), Glurk (Glu), and a truncated light antenna (TLA) mutant of the John Williams variety were harvested at ~8 weeks old at the same time (1 PM) and prepared by weighing each leaf (ranging from 0.39 g for Glu to 0.60 g for JW), flash freezing with liquid nitrogen, and powdering using a mortar and pestle. The powdered plant material was transferred into 20 mL of acetonitrile followed by 30 min of ultrasonication in a room temperature bath and then stored at 4° C. for 24 h. The solutions were centrifuged at 7000 g for 10 min, and the supernatant was extracted to minimize the amount of solid plant material in the solutions. Mass spectra of these solutions were acquired using a Waters Quadrupole-Time-of-Flight (Q-TOF) Premier mass spectrometer (Waters, Milford, Mass.) in the positive ion mode. A solution of pure acetonitrile was processed in the same manner as the plant extracts, and a mass spectrum of this solution was acquired to provide a measure of the background/contaminate signals. The mass spectra reported for the plant extracts are background-subtracted.

Example—Transfer Efficiency of Ablated Sample Material

The efficiency of transferring sample from a surface to the ESI emitter was investigated by IR laser ablation of droplets containing 1 mM nicotine in ~85/15 glycerol/methanol solution. The sample is uniformly distributed in a matrix of glycerol, because glycerol evaporates slowly at ambient conditions and strongly absorbs IR light at 2.94 μm wavelength. Biological samples are more complex than glycerol and transfer efficiencies for biological samples are expected to differ. The droplets were deposited on Teflon tape attached to a glass microscope slide. Teflon was used because the droplets formed uniform spheres instead of variable shapes when deposited onto glass. In order to determine a transfer efficiency (defined here as the moles detected/mol ablated× 100%), the volume of material ablated by each laser shot must be known. The ablation volume per laser shot was determined from the number of laser shots required to completely ablate a 1 μL droplet of the glycerol/methanol solution. This value is 1000±200 laser shots and was measured using sets of 50 consecutive laser shots (2.5 s) and a 30 s delay between each set to reduce effects of droplet heating. These results indicate that 1.0±0.2 nL of solution, which contain ~$1\times10^{-12}$ moles of nicotine are ablated per laser shot. This corresponds to an ablation depth of ~30 μm into the droplet.

Figure 10:
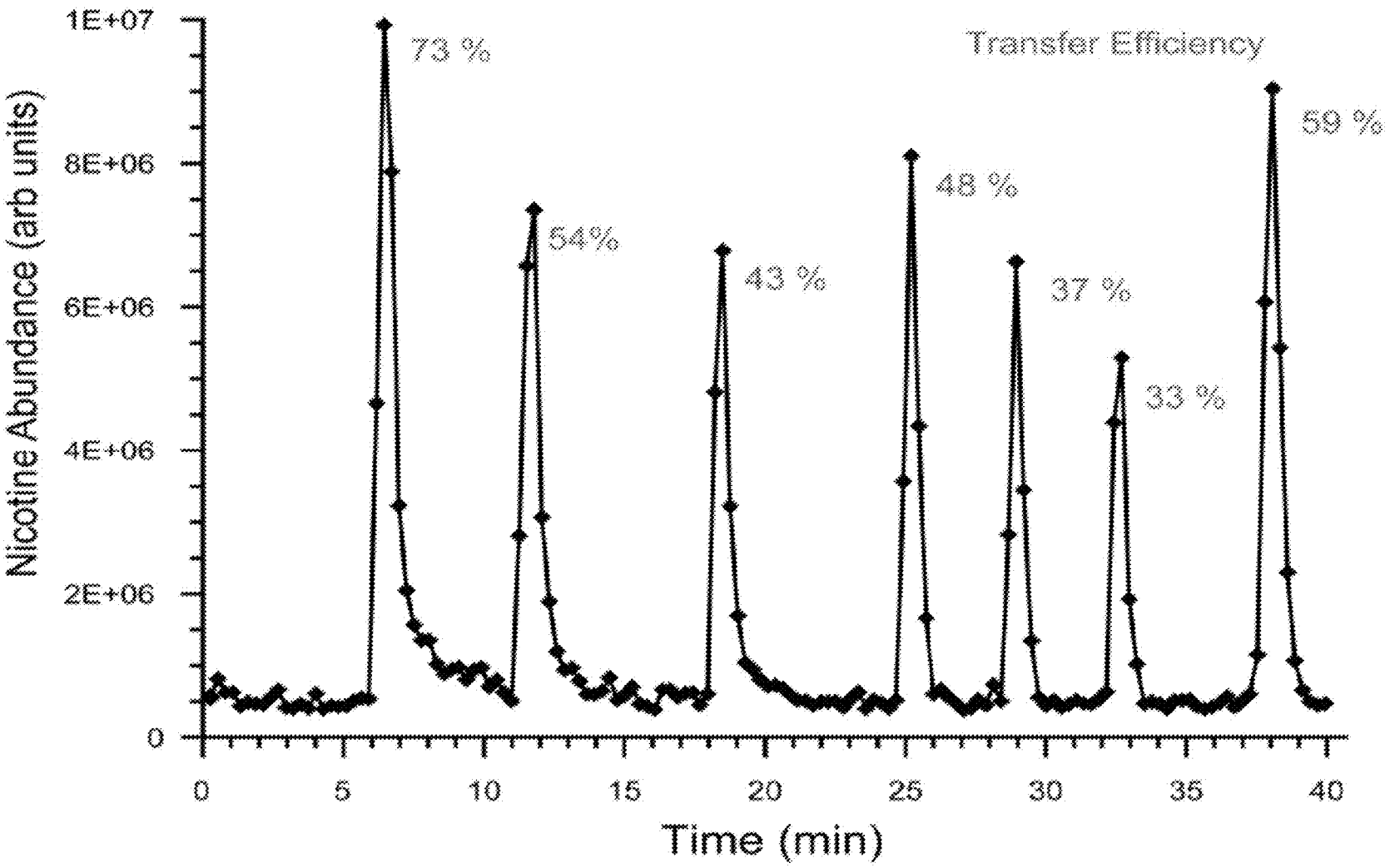
FIG. 10 shows an example of ion abundance as a function of time for protonated nicotine measured by laser ablation from a 10 μL droplet of 85/15 glycerol/methanol containing 1 mM nicotine. Sets of 10 laser pulses were used to ablate the sample material. The transfer efficiency, defined as moles detected per mol ablated, is labeled next to its corresponding peak.
Figures 11A, 11B, 11C, 11D:
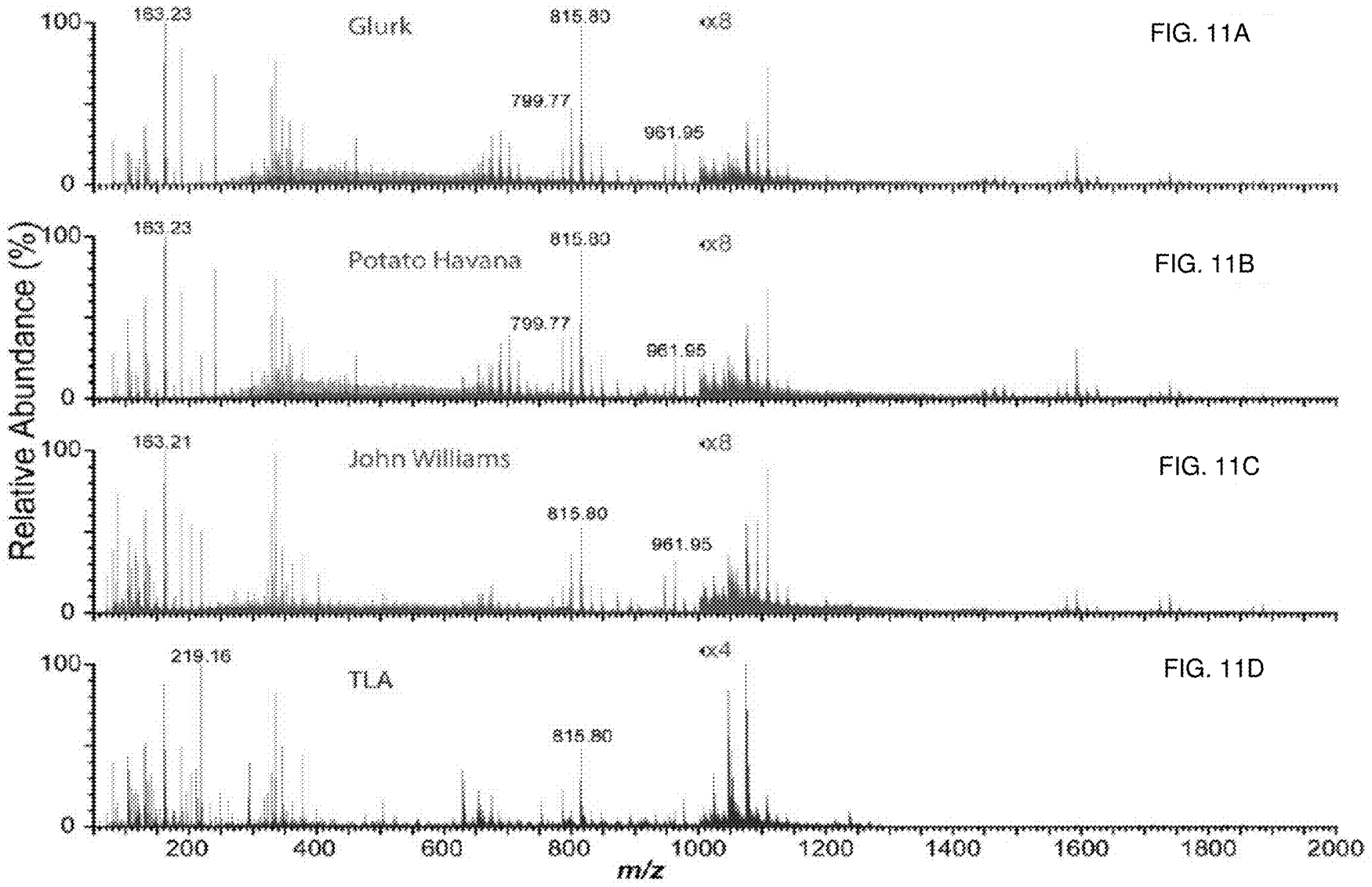
FIGS. 11A-11D show examples of positive ion nanospray mass spectra of tobacco leaf extracts in acetonitrile from four plant varieties.

The transfer efficiency was determined by comparing the protonated nicotine ion abundances from AIRLAB to that obtained from ESI of a standard nicotine solution. A 10 μL droplet was used in these experiments because the surface is flatter and results in higher reproducibility. Bursts of 10 laser shots were used to ablate the sample, and the protonated nicotine abundance as a function of time shows spikes for each set of 10 laser shots (FIG. 10). Protonated nicotine appeared ~90 s after the laser ablation, and the signal was observed for ~60-75 s. The area under each peak in the time-dependent nicotine signal was integrated, and the resulting integrated nicotine ion abundance values were scaled to account for the 10 s of each measurement cycle during which ions were not accumulated and measured with the mass spectrometer. These measured values were converted to mole equivalents using calibration data obtained under the same experimental conditions using nicotine standards in the same solvent (1:1 $H_2O$:MeOH; 1% acetic acid). The transfer efficiency was determined for each set of 10 laser pulses (FIG. 10, values labeled for each peak), and the average value of these seven measurements was 50±14%. The variability in the transfer efficiency is likely due to environmental/sample variations, such as bubble formation. Bubbles were occasionally observed on the surface of the droplet after laser ablation and may change the ablation plume formation and direction. Reproducibility experiments on plant tissue were also performed and are discussed below.

The transfer efficiencies from the droplets obtained using AIRLAB-MS are significantly higher than those reported for other laser ablation mass spectrometry techniques. Murray and co-workers reported that the transfer efficiency obtained in their infrared ablation experiments was 2%. The transfer efficiency of LAESI has not been reported, but the technique is described as being "characterized by significant sample losses and low ionization efficiencies." The high transfer efficiency obtained for the AIRLAB-MS system is likely a result of positioning the probe droplet directly above the surface where the laser is focused. Unlike LAESI, which relies on the intersection of two plumes of small droplets (ablation and electrospray), this technique takes advantage of the apparently more efficient process of capturing the ablated material in a liquid surface. Ablation plumes induced by front-side IR laser pulses have been imaged by Vogel and co-workers, who showed that most of the material is ejected directly upward from the sample surface. With a back-side ablation geometry, the material is vaporized at the interface of the sample with the sample holder, such as an indium-tin-oxide-coated quartz microscope slide, instead of the interface of sample with atmosphere. Thus, the material ejection is unlikely to form the same plume shapes as reported for front-side irradiation, which may contribute to the lower (2%) transfer efficiencies. An additional advantage of the AIRLAB-MS experimental setup over back-side laser desorption is the ability to analyze samples that are thicker than the laser penetration depth.

The combination of liquid surface capture and the use of a reflecting IR objective for front-side laser ablation enables both small laser spot size and the positioning of the probe droplet directly above the laser focus. Instead of focusing the IR laser through a lens or fiber-optic directly above the sample surface, which would then be blocked by the sample probe, the reflecting objective (FIG. 1A) directs the laser light so that it is angled under the probe with the focal plane parallel to the sample surface. This geometry allows the liquid surface of the probe to be positioned close to the sample surface without increasing the laser spot size, which would occur for laser light focused at an angle underneath the droplet.

The effect of laser power on the ion signal obtained from a glycerol droplet containing 1 mM bradykinin was investigated by placing a variable attenuator between the IR laser and the microscope. Bursts of 10 laser shots were used to ablate material from the droplet and the abundance of doubly protonated bradykinin was monitored. There is no bradykinin signal at 1.8 mW, but the signal increases substantially from ~2.1 to 13.6 mW. These results indicate that the maximum material transferred to the probe for these experiments occurs with ~14 mW and even more laser power may lead to a further increase.

To determine if fragmentation of biomolecules occurs with AIRLAB-MS, glycerol droplets containing leucine enkephalin (~555 Da), bradykinin (~1060 Da), or myoglobin (~17 567 Da) at 1 mM concentration were analyzed. No fragmentation products were observed, except for the loss of the noncovalently bound heme group and a 4+ ion signal at ~694 m/z from myoglobin, assigned to the $y_{25}$ fragment (measured mass, 2774.14 Da, predicted mass, 2774.45 Da). Apo-myoglobin and the $y_{25}$ ion were also observed for direct electrospray ionization of 1 μM myoglobin using the same ESI emitter, conditions, and solvent as the ablation experiments (50/50 $H_2O$/MeOH 1% acetic acid), indicating that the $y_{25}$ ion is not formed by the ablation laser. The loss of heme group is likely caused by denaturing of the protein in the solvent, but this process and formation of the $y_{25}$ ion may occur in the ESI interface. The charge state distributions and average charge states observed for laser ablation transfer and direct electrospray ionization of myoglobin are very similar, +18.1 and +17.6, respectively. The lack of significant fragmentation indicates that the sample transfer by IR laser ablation with the instrumental design is sufficiently gentle to provide intact molecular ions by ESI, consistent with previous results. The mass range of molecules transferred, up to ~17 kDa, indicates that AIRLAB-MS is suitable for analysis of larger peptides and proteins as well as small metabolites. The gentle transfer and ionization conditions indicate that this technique can be used to study a wide range of biomolecules, and perhaps biomolecular complexes if native conditions are used.

The sensitivity of these measurements can be estimated from the signal-to-noise ratio (S/N) of the ion signal and the volume of material ablated estimated from the number of laser shots. This sensitivity is affected by the transfer efficiency of the laser ablation process as well as the sensitivity of the mass spectrometer. For leucine enkephalin, bradykinin, and myoglobin, the detection limits (S/N=3) based on the mass spectra and the number of laser shots (10, 20, and 200) are ~130 femtomoles, 50 femtomoles, and 3 picomoles, respectively. For myoglobin, significantly more laser shots (200, averaged over four sets of 50) were required to obtain sufficient S/N to investigate the possibility of fragmentation because the ion signal is spread out over many charge states and isotope peaks. The measurements presented here were performed only in positive-ion mode, but electrospray ionization and AIRLAB-MS are also capable of generating negative ions by changing the polarity of the electrospray and ion optic potentials, which enables the analysis of an even broader range of biomolecules.

Example—Application to Tobacco Plant Varieties and Nicotine Distribution—Chemical Composition of Tobacco Varieties Four genetically different tobacco plants, Petite Havana (PH), John Williams (JW), Glurk (GluC), and John Williams variety with truncated light antenna (TLA) plants, were harvested and the chemical compositions of individual leaves from each plant (4th leaf from the top) were analyzed by solvent extraction followed by mass spectrometry. The positive ion ESI mass spectrum for each sample has many ions. Those at m/z 799.41, 815.39, and 961.44 (FIGS. 11A-11D) are identified as diterpene glycosides, lyciumoside IV, II, and VII, respectively, based on comparisons of the measured masses to those of compounds in a tobacco plant metabolite database and prior reports of extracted compounds from similar tobacco plants. These ions are significantly more abundant for GluC and PH than for JW and TLA. There is a distribution of ions between m/z~690 and 710 in the mass spectra of GluC and PH with slight differences in the relative ion abundances, but these varieties are chemically the most similar. These ions are significantly less abundant for JW and TLA. The mass spectrum of TLA shows the greatest chemical differences in the relative abundances of the ion at m/z 219.16 and of ions between m/z 1000 and 1150. The JW and TLA plants were selected for laser ablation experiments because JW is the corresponding wild-type variety of the TLA mutant, and the mass spectra for the whole leaf extracts show differences in their chemical composition.

Example—Application to Tobacco Plant Varieties and Nicotine Distribution—Reproducibility of Ablation from Plant Material In order to characterize the reproducibility of the laser ablation transfer process for plant tissue samples, a small (~2 cm diameter) leaf from a tobacco seedling was used as a sample. A young plant leaf, ~3 weeks old, was selected to minimize variations in the leaf tissue due to vasculature (leaf veins) and trichomes (small hairs) both of which are more prevalent in mature leaves. The smaller leaf is also more flexible and adheres readily to the microscope slide. The AIRLAB-MS system was programmed to ablate an area of ~360×360 μm by moving the sample through a 4×4 grid of positions separated by 90 μm. A laser pulse frequency of 5 Hz was used corresponding to ~375 total laser shots. Plant material in a given spot (diameter ~90 μm) was typically completely ablated within 3 laser shots, requiring effectively ~48 laser shots to ablate the entire 360×360 μm area. However, to better ablate thicker plant material and to ensure the entire target area was ablated, 375 shots were used. Six closely spaced areas (within 2×2 mm) were ablated for comparison.

The most abundant ion (m/z 245.081) in the mass spectra of the young leaf is likely protonated uridine based on its exact mass and comparison of this mass to those of compounds in a database of tobacco plant metabolites. The average peak area from the six ablation spots is $5.48 \pm 0.45 \times 10^7$ (arb. units). The variability in the protonated uridine abundance (standard deviation of less than 10%) includes contributions from the measurement reproducibility as well as any spatial variability in the concentration of uridine in the areas measured. The reproducibility obtained in these experiments indicates that relative changes in the spatial distribution of compounds from plant tissue can be measured with reasonable precision.

Figure 12:
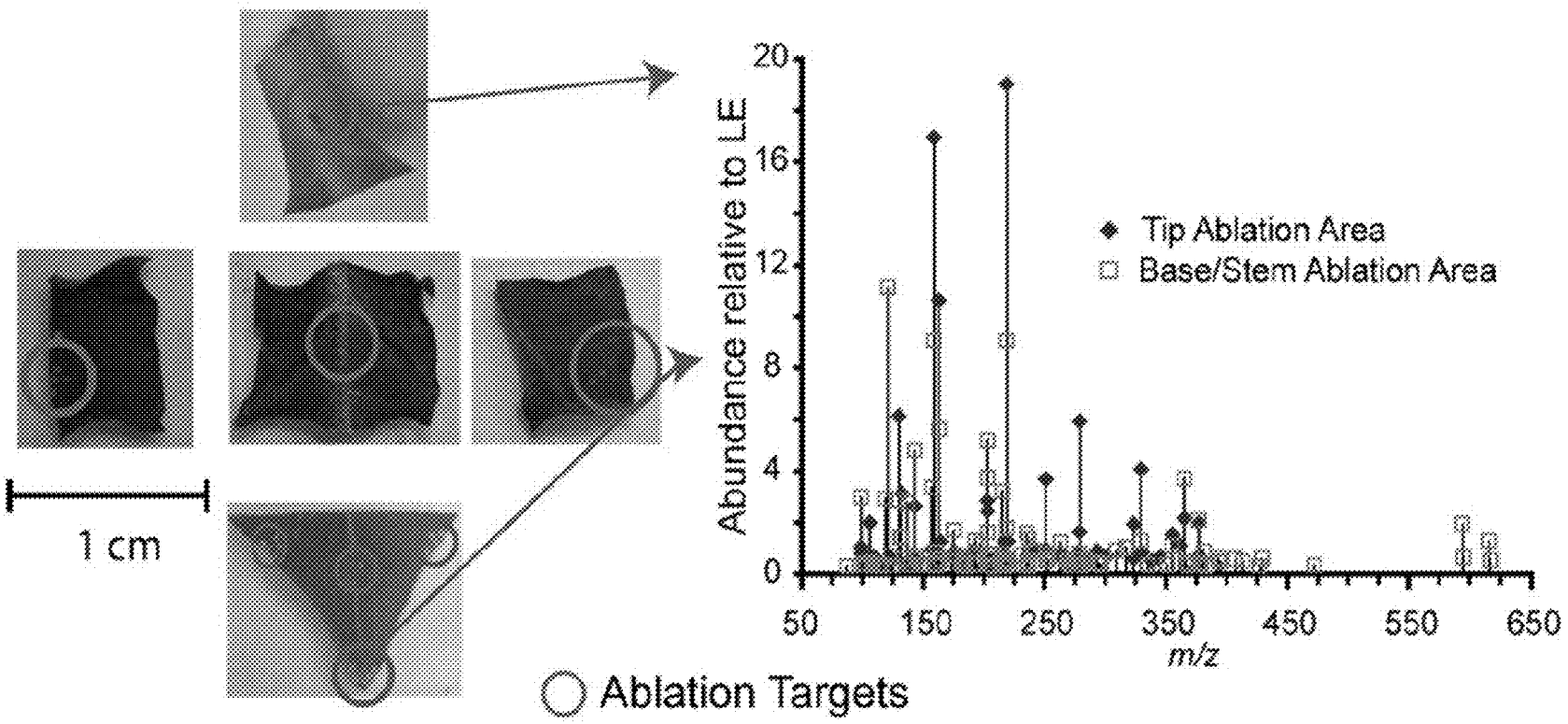
FIG. 12 shows examples of images of tobacco leaf samples from a John Williams plant, and the general areas selected for laser ablation are indicated by circles. Representative mass spectra for the leaf tip and leaf base/stem are also shown.

Example—Application to Tobacco Plant Varieties and Nicotine Distribution—Laser Ablation of Mature Tobacco Leaves For analysis of spatial variations in the chemical compositions of the John Williams and TLA tobacco leaves, eight locations were selected (indicated by circles in FIG. 12). Four locations are within 1 cm of the tip of the leaf, three are on the leaf midsection, and one is on the stem at the base of the leaf. These locations were selected to provide a variety of plant tissue types and ages. At each location, at least three 360×360 μm ablation areas using the same 4×4 grid programmed for the reproducibility experiments were analyzed. The trichromes or leaf hairs were much more developed and prominent for these mature leaves compared to the young leaf used in the reproducibility measurements. There is a greater (20% on average) variability in ion abundances for these more mature leaves, likely caused by the unpredictable and variable effects of the leaf hairs on the sample transfer efficiencies. Two representative mass spectra from different ablation locations are shown in FIG. 12. Each mass spectrum consists of the averaged ion abundances from all spectra measured for the indicated area (tip or vein) where the S/N for protonated nicotine is greater than three.

In total, approximately 50 ions, excluding isotope and background ions, were observed for laser ablation of the tip region and approximately 100 for the base/stem region. Of these ions, 28 were common to both regions. The greater number of ions for the base region may be due to the greater thickness of the stem, which provides more material for transfer and thus more signal for low concentration compounds. The most abundant ions in the mass spectra of the two ablation regions are at m/z 98.986, 120.968, 163.125, 203.044, and 219.025. On the basis of the comparison of the measured accurate masses to a tobacco plant metabolite database, these ions are assigned as protonated phosphoric acid, potassiated pyrimidine-ring, protonated nicotine, sodiated hexose (most likely glucose), and potassiated hexose, respectively. The abundant ion at m/z 158.025 is consistent with multiple sodiated metabolite isomers with elemental composition ($C_5H_4N_4O$), including hypoxanthine and 8-hydroxypurine.

To compare the ions detected using AIRLAB-MS with those obtained from solvent extraction, the extract solution for the John Williams leaf was analyzed using nanoelectrospray ionization on the FT/ICR instrument with conditions similar to those used for laser ablation but with a different solvent (acetonitrile for extraction and $H_2O$/MeOH for laser ablation). Ion abundances from five mass spectra were averaged, and their exact masses were compared with those of the ions for laser ablation of the tip and stem/base regions. There are approximately 270 ions with m/z ranging between 104 and 1240 in the mass spectrum of the solvent extract. Approximately 30 of these ions were also observed in the laser ablation experiments on the leaf, but some ions detected with laser ablation were not observed in the extract spectrum. Several of the most abundant ions for laser ablation are also abundant for the solvent extract, including protonated nicotine and sodiated and potassiated hexose. However, the most abundant ion in the mass spectrum of the extract with m/z 345.209 has low relative abundance in the laser ablation mass spectrum for the leaf tip (FIG. 12). There are also many ions with m/z>650 in the spectrum of the extract, whereas no ions were observed in this range in the laser ablation experiments. This may be due to the much longer dissolution time used for the solvent extraction compared to laser ablation and the different solvents used.

Figure 13:
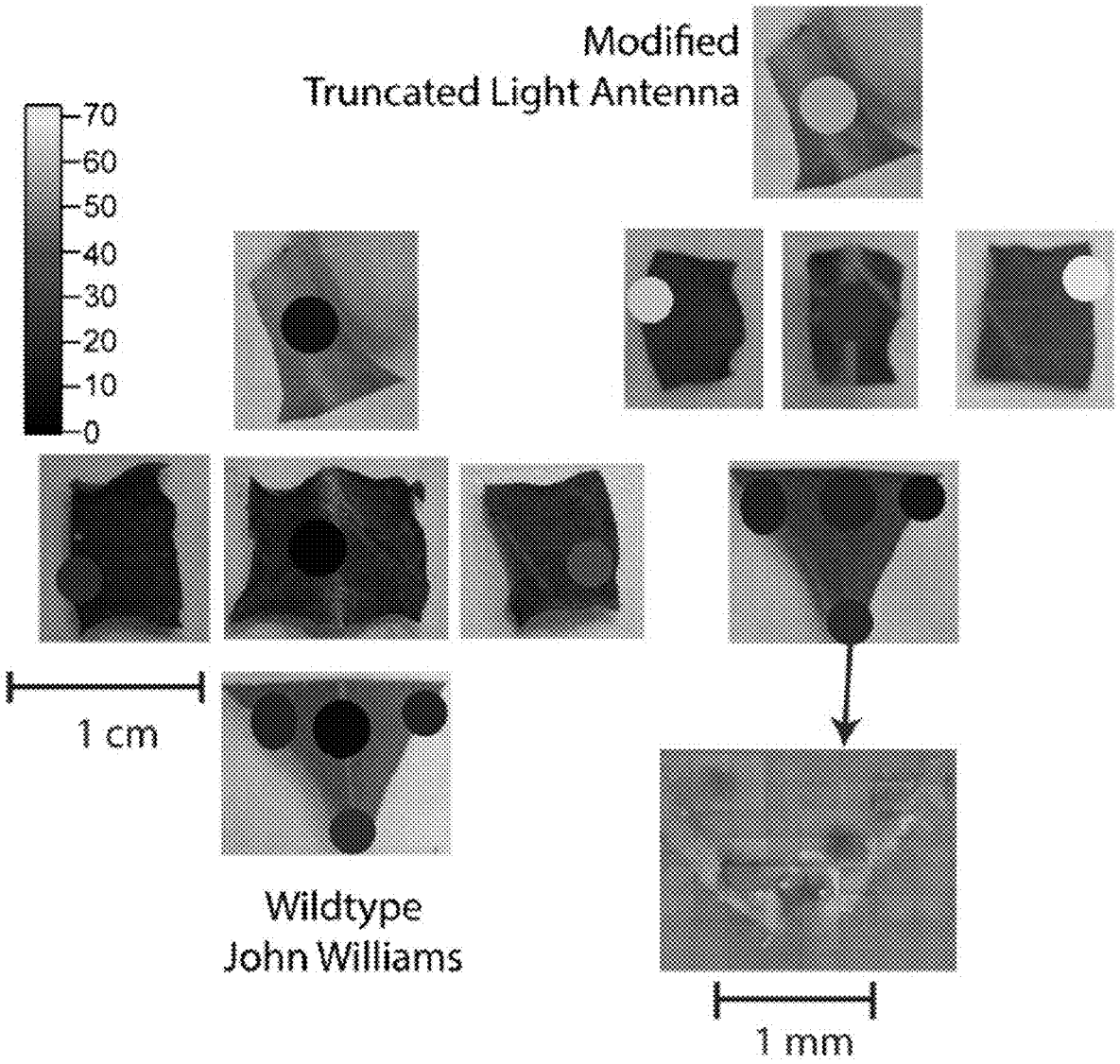
FIG. 13 shows example of average nicotine abundances measured for laser ablation of three 360×360 μm areas of plant tissue from each of the circled areas of John Williams and TLA mutant tobacco leaves. The average integrated nicotine abundance is indicated by the shading of the circle. Expansion of the TLA mutant tip shows dark spots indicating ablation craters.

To visualize variations in the relative amount of nicotine for both the John Williams and TLA leaf samples, the color of the circles for each of the ablation areas was selected to correspond to the relative nicotine concentration at that location (FIG. 13). The nicotine levels for the TLA leaf, measured with a leucine enkephalin internal standard, were higher than for JW by an average of 360%. The nicotine levels at the TLA midleaf edges, vein, and stem were higher by 200-1200%. The only areas where the nicotine level is lower in TLA were at the tip edges, where the signal is 65% of that measured for JW. The general spatial distribution of nicotine is similar for both plants. There is more nicotine at the leaf edges and tip and less along the plant vein. The higher nicotine levels in the TLA leaf are consistent with previous metabolite analysis of TLA mutants, which showed increased photosynthetic productivity for TLA mutated green microalgae. These results are also consistent with the data from the leaf extracts which indicated that the absolute nicotine abundance in the TLA extract is greater than the wild-type; however, the nicotine concentrations for these extracts were not quantified. Similar mapping for phosphoric acid abundance shows higher phosphoric acid concentration at the midvein and base/stem for both plant varieties and generally higher concentration for the TLA variety.

SECOND SET OF EXAMPLES

Example—Solvent Droplet Size Measurement

The size of the solvent droplet used to capture material from the ablation plume generated by the laser is an important parameter for both sensitivity and reproducibility of the mass spectrometry signal with AIRLAB. A system to control droplet size was developed that uses optical imaging of the droplet to provide feedback to a syringe pump that controls the solvent flow rate in order to change the droplet size as desired.

The droplet size measurement system comprises a red diode laser and beam expander that irradiates the droplet. The resulting light is passed through a semi-transparent screen and is recorded in real time using a USB webcam. The droplet image is isolated by background subtraction and the number of pixels in the image is used to determine the droplet size. This process is calibrated using the known size of the metal capillary from which the droplet is suspended. The droplet size measurement is used in a closed loop control feedback (Proportional Integral Derivative) to control the flow rate of the syringe pump that provides solution to the droplet. This feedback system operates at a rate of 2 Hz and makes possible a fine control of the droplet size with a precision of ±0.1 mm.

The droplet size measurement system and the droplet support were integrated in a single device that enabled changes of the droplet support capillary height above the sample without recalibrating the measurement system. For these experiments, the droplet support was positioned 4 mm above the sample. The average solvent flow through the capillary was ~80 μL/min. The liquid flow is stopped 20 s after the last laser shot of an ablation event and then is restored 30 s thereafter. The droplet size was significantly reduced when the flow is reduced to zero which resulted in most of the solution with the ablation products directed to the ESI source of the mass spectrometer. Under these conditions, ions from an ablation event are produced and introduced into the mass spectrometer for about 50 s. All operations, including the microscope stage and laser operation (rate, pulses, etc.), were controlled by in-house software in Labview (National Instruments, Austin, Tex.).

Except where otherwise specified, the cross sectional area of the droplet in the EXAMPLES set forth below was 1.5 $mm^2$, corresponding to a diameter of 1.4 mm and a volume of 11.4 μL if the droplet is spherical. A measure of the droplet volume was obtained from the length of time it took for the droplet to be introduced into the capillary and from the solution flow rate into the electrospray source. A value of 12 μL was obtained from this measurement, which is close to the value obtained from the measured cross section.

Example—Mass Spectrometer and Electrospray

A computer controlled syringe pump was used to control the flow rate of the electrospray solution (1:1 methanol: water containing 0.66 μM Leu-enkephalin (LeuEnk) and 0.1% acetic acid). A potential of +3.5 kV was supplied to the homebuilt electrospray system. LeuEnk was used as a standard to calibrate both mass spectra and to monitor and account for variations in the ion abundance generated by electrospray. Mass calibration was done using a CsI solution and an average mass accuracy of 6.6 ppm (17 ppm maximum deviation) between m/z 130 and 3000 was obtained. The relatively poor mass measuring accuracy is likely due to large temperature fluctuations and often high temperature (28° C.) at where the experimental system was located Example—Laser Ablation The infrared microscope was equipped with a 15× reflecting objective to focus the light from the mid-IR laser. The laser beam was passed through a home-built refractive telescope prior to its entrance to the IR microscope. This additional collimation-focusing element increased the power by a factor of two. In the EXAMPLES below, the mid-IR laser wavelength was set at 2.94 μm, the power ~1.5 mJ/pulse, the pulse width 5 ns, and at a repetition rate of 20 Hz. The wavelength was selected to overlap with the OH-stretch vibration absorption from water and other macromolecules in the sample, which allows the sample's intrinsic materials to be used as a matrix to absorb the energy of the pulsed mid-IR laser.

The telescope improved focusing, resulting in a smaller laser ablation spot size using a square diaphragm of the microscope. For onion skin, an ablation with 50 laser shots with the diaphragm fully open resulted in a spot size of ~150 μm diameter and a signal-to-noise ratio (S/N) for a monosaccharide at m/z=219.03 of 47 over the 50 s duration of signal. The spot size can be reduced to a square ~50 μm length and resulted in a S/N for the same monosaccharide of 9. This spot size is comparable to that obtained by LAESI using an optic fiber (30-40 μm), opening the possibility of using the experimental system to perform single cell mass spectrometry measurement. All other experiments were performed with the diaphragm fully open in order to maximize ion signal in the mass spectrometer.

Example—Ablated Volume Per Laser Shot

In order to determine the ablation transfer efficiency, defined as the efficiency of transferring material that is ablated from the sample into the hanging droplet, the volume of the sample ablated with each laser shot must be known. The ablated volume per laser shot was determined from the number of laser shots required to completely ablate a 10 μL droplet of water and a 1.0 μL droplet of glycerol/methanol solution, each containing 100 μM of BK. The number of laser shots required to completely ablate the water and glycerol/methanol droplets was 750±120 and 980±220, respectively. Thus, each laser shot ablates approximately 13 nL of water and 1 nL of glycerol/methanol. In order to determine if the initial size of the droplet affected this measurement, for example by heating and increased evaporation, the experiment was repeated using a 1 μL droplet of water containing 100 μM of BK. The measured ablated volume per laser shot was 12 nL, consistent with negligible droplet heating and evaporation in these measurements.

Example—Gas Confinement

In order to potentially increase the transfer efficiency in the laser ablation process, a device to confine the laser ablation plume using a flow of $N_2$ gas was developed by 3D modeling of the gas flow and then the device was made using a Form 2 3D printer (Formlabs, Somerville, Mass.). The gas confinement device was used as the sample support under the microscope. The flow rate of $N_2$ gas was controlled with a gas flow controller on the mass spectrometer. A schematic diagram of the gas confinement device used for the EXAMPLES below is shown in FIGS. 4-7. The gas confinement device serves to confine the ablation plume generated by the laser using a flow of $N_2$ gas that flows through 12 holes surrounding the sample. The gas flow is initially perpendicular to the plume. The holes have a diameter of 1.0 mm and are 0.5 mm above the sample platform resulting in a gas stream that is in the plane of the sample and is symmetrical. This gas flow increases the pressure in the sample plane and the intersection of all gas streams in the center of the device produces a gas stream perpendicular to the sample along the axis of the plume. The resulting flow confines the plume and pushes the plume higher so that more of the ablated sample can be deposited into the hanging solvent droplet.

Example—Computational Fluid Dynamic Modeling

The design of the ablation plume confinement device was modeled with fluid dynamics simulations using the 2017 Autodesk Computational Fluid Dynamics (CFD) package (Autodesk, San Rafael, Calif.) in combination with Autodesk Inventor for designing the model. The Navier-Stokes equations are solved using a (k−ε) turbulent model. Boundary conditions for the gas inlet and vents were obtained from the experimental value of 75 L/h of $N_2$ at the inlet and ambient pressure at the outlet.

Particles trajectories simulations were done with two sets of initial conditions using 100 independent particles randomly distributed inside a circle of 200 μm diameter in order to simulate the laser ablation spot size. The trajectories are corrected for gravity by enabling this option in the 2017 Autodesk CFD package.

TABLE

Initial conditions for the particle trajectories simulation using two set of particle densities as described by the bi-model distribution measured the literature.

| Variables | Set 1 | Set 2 |
|---|---|---|
| Initial Velocity ($m \cdot s^{-1}$) | 150 | 150 |
| Particle Density ($\mu g \cdot mm^{-3}$) | 250 | 350 |
| Particle Radius (nm) | 100 | 10000 |
| Number of particle simulated | 100 | 100 |

Example—Samples

Onions were obtained from a local supermarket. Bradykinin solutions at different concentrations were prepared in either water or a mixture of 85:15 glycerol:methanol and a 10 μL droplet was deposited onto a quartz cover slip and ablated. Onion samples were prepared by taking off the first layer and using an inside layer (typically the $5^{th}$ or $6^{th}$). The top of the layer was then cut with a scalpel to make a 5×5 mm square with 300 μm thickness.

Example—Transfer Efficiency

Figures 14A, 14B:
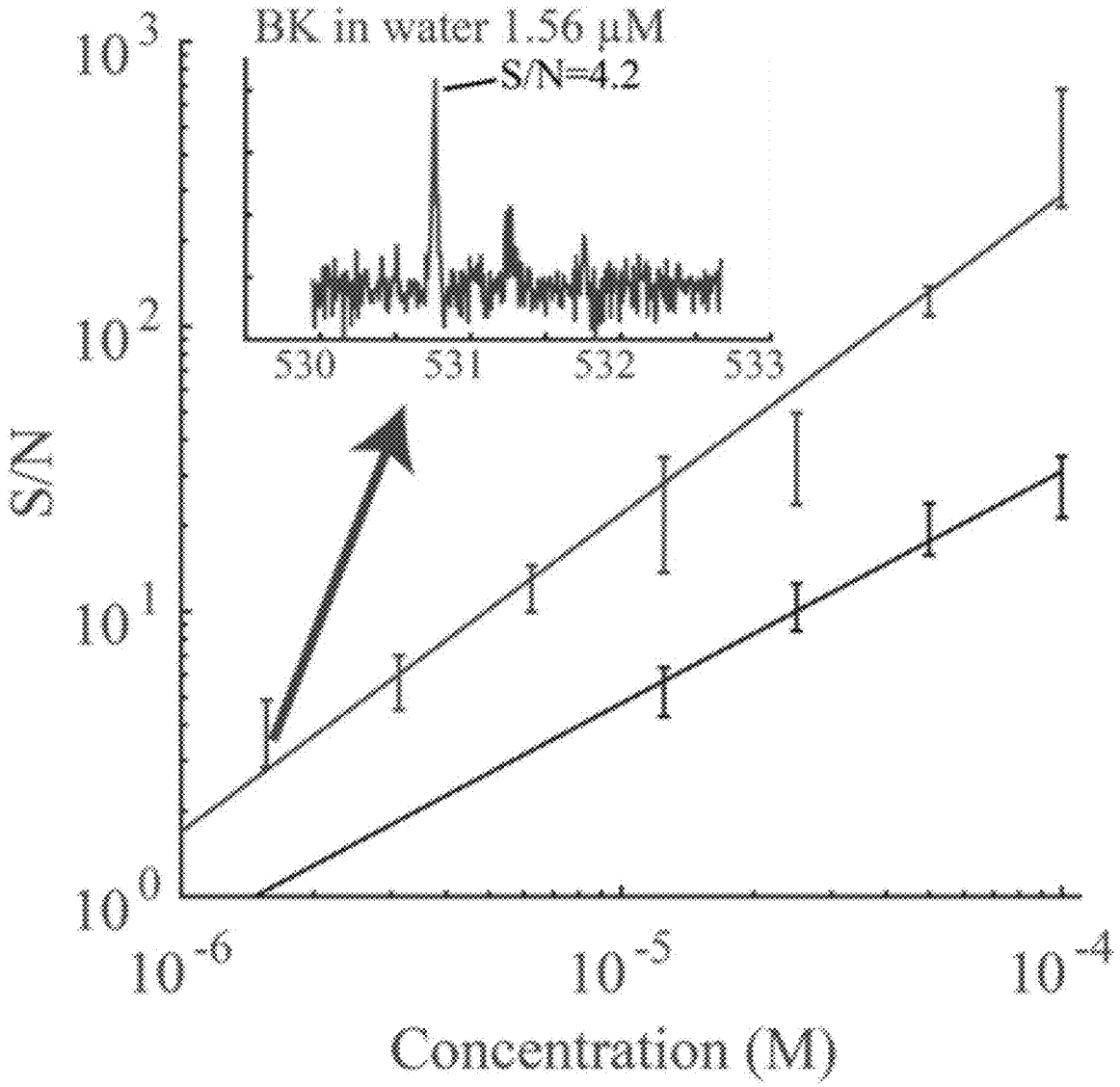
FIGS. 14A and 14B show example of graphs of the signal-to-noise ratio (S/N) of doubly protonated bradykinin formed by AIRLAB-MS from samples consisting of bradykinin in water and 85:15 glycerol:methanol as a function of sample concentration. Each sample was ablated with 50 laser pulses, and each experiment was repeated five times. The mass spectra were averaged for the duration of sample introduction into the mass spectrometer.

The transfer efficiency of a nine residue peptide, bradykinin, from the sample solution to the hanging droplet in AIRLAB-MS was determined for two different matrices consisting either of pure water or a 85:15 glycerol:methanol mixture. A 10 μL volume of each solution was deposited onto a quartz plate under the microscope and 50 laser shots were used to ablate sample from the 10 μL droplet. The signal of doubly protonated bradykinin as a function of concentration in these two matrices are shown FIGS. 14A and 14B. The data are linear and yield a correlation coefficient of at least R=0.97 for both matrices. A signal-to-noise ratio (S/N) for bradykinin of four was obtained at a concentration of 1.6 μM in water and five for 12.5 μM in glycerol.

The resulting signal was compared to standard solutions in the flowing solvent to determine the mole equivalents of each laser shot, resulting in a transfer efficiency of 35±15% for water and 80±25% for glycerol/methanol.

The transfer efficiency with the glycerol/methanol droplet was higher than the 50±15% value previously reported for the AIRLAB system described in U.S. Pat. No. 9,805,921. This efficiency does depend on a number of factors, but the higher laser power obtained here likely results in higher transfer efficiency. The transfer efficiencies from the droplets obtained using AIRLAB-MS are significantly higher than those reported for other laser ablation mass spectrometry techniques.

From the ablation volume per laser shot, the limit of detection (LOD) can be determined by extrapolating the data to a S/N=2, which corresponds to a detectable concentration of bradykinin of 1.2 μM for water and 3.5 μM for glycerol. The LOD is thus 750 fmol for BK in water and 165 fmol in glycerol. These values are higher than the limit of detection of LAESI for which the detection limits of verapamil and reserpine in water are 8 fmol and 25 fmol respectively.

The high efficiency transfer and high LOD for AIRLAB MS compared to the low transfer efficiency and low LOD for LAESI-MS is largely attributable to the different plume capture design of the two techniques. With LAESI, the ablation plume intersects the small electrospray droplets which apparently results in low transfer efficiency. However, the droplet size is small so that the material that is transferred is present in the droplets at high concentration. This has the advantage that there is a fast signal response ion pulse length of about one to two seconds which makes this technique suitable for imaging. In contrast, the transfer of ablated material to the hanging droplet in AIRLAB is highly efficient, but the plume is diluted in a relatively large droplet leading to a higher LOD. However, the ion signal from an ablation event lasts around 50 s. This makes imaging untenably slow in the current configuration, but it does make possible the measurement of MS/MS spectra of a large number of precursors with high spatial resolution. In combination with IR spectroscopy, this setup should enable high resolution imaging using IR with chemical information obtained by both IR spectroscopy and MS/MS of many precursors with good spatial resolution at locations of interest. The LOD for the AIRLAB design could be improved by reducing the size of the hanging droplet.

Example—Gas Confinement—Simulation

In order to understand and optimize the performance of the gas confinement device, simulations with different device designs and inlet gas flow rates were investigated. Effects of the number of holes (between four and twelve), the height of the holes above the sample (between 0.5 mm to 2 mm) and the gas flow rate (between 50 L/h and 150 L/h) were explored. The best geometry within this range of parameters was found to be 12 holes at 0.5 mm height, which resulted in the least turbulence and best particle transport within this range of parameters.

The result of the simulation for this geometry with an inlet gas flow of 75 L/h is shown FIGS. 15A-15C. The gas velocity and flow in the vertical midplane are shown FIG. 15A. When the gas streams interact near the center, the horizontal gas stream is directed vertically and there is a region of "low velocity" created in the center (FIGS. 15A and 15B). This center zone immediately above the sample has zero velocity in the horizontal directions and a low velocity of 50 mm/s in the vertical axis. This zone has an almost circle shape with a diameter of 1.5 mm. The low velocity region is accompanied by an increase in pressure (FIG. 15C) to a maximum one Pa in the center.

The gas flow dynamics modeling confirmed the expectation that the device should confine the ablation plume in the horizontal plan and should elevate the ablated material to the hanging droplet. Particle trajectory simulations for the same gas flow were performed with particle sizes of 100 nm and 100 μm. The trajectories are similar for both particle sizes and indicate that the particles are pushed vertically with a 0.9 mm offset from the center. This offset appears to be due to an incomplete symmetry of the gas stream (FIG. 15B). The particles are focused in a small 0.6 mm diameter area that should be readily captured by a 1.4 mm diameter hanging solvent droplet and should enable smaller hanging droplets to be used.

Example—Gas Confinement—Improved Sample Transfer with Glycerol/Methanol Matrix

The gas confinement device that performed the best in these simulations was printed and its performance was tested with a 10 μL droplet of 85:15 glycerol:methanol with 100 μM of bradykinin. The gas flow was varied from 0 to 150 L/h, the droplet was irradiated by 50 laser shots, and mass spectra were obtained. Each experiment was repeated five times.

Figure 16:
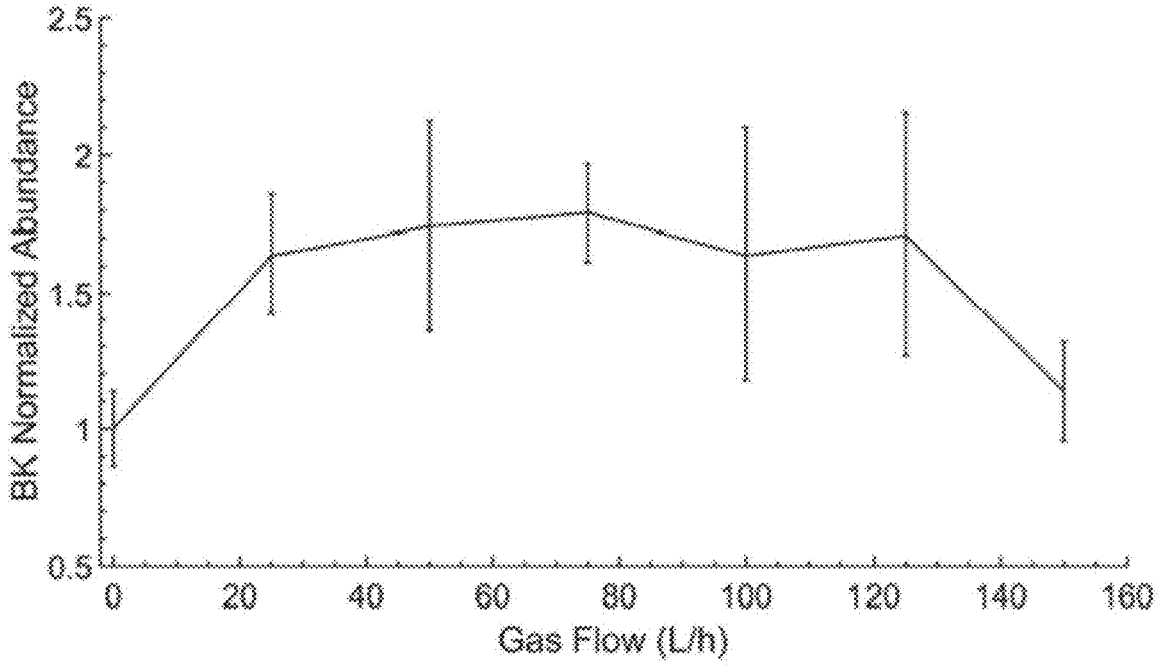
FIG. 16 shows an example of the normalized abundance of doubly protonated bradykinin ions formed from a glycerol:methanol droplet (85:15) as a function of the $N_2$ gas flow through the gas confinement device. The abundance of bradykinin with no gas flow is normalized to 1.

The abundance of doubly protonated bradykinin as a function of $N_2$ gas flow rate is shown in FIG. 16. The abundance of bradykinin increases with gas flow, reaches a broad maximum between 25 and 125 L/h before decreasing at higher flow rates. At the center of the broad maximum (flow of 75 L/h), the abundance of bradykinin is increased by a factor 1.8±0.2. This increase in transfer efficiency is high given the previously obtained transfer efficiency of 80±25% without this device, but these values are self-consistent within the limits of the uncertainties in these measurements. From these results, it appears that the majority of material that is ablated from the sample is transferred into the hanging droplet with this gas confinement device.

Example—Gas Confinement—Improved Sample Transfer with Onion Skin Sample

Figure 17:
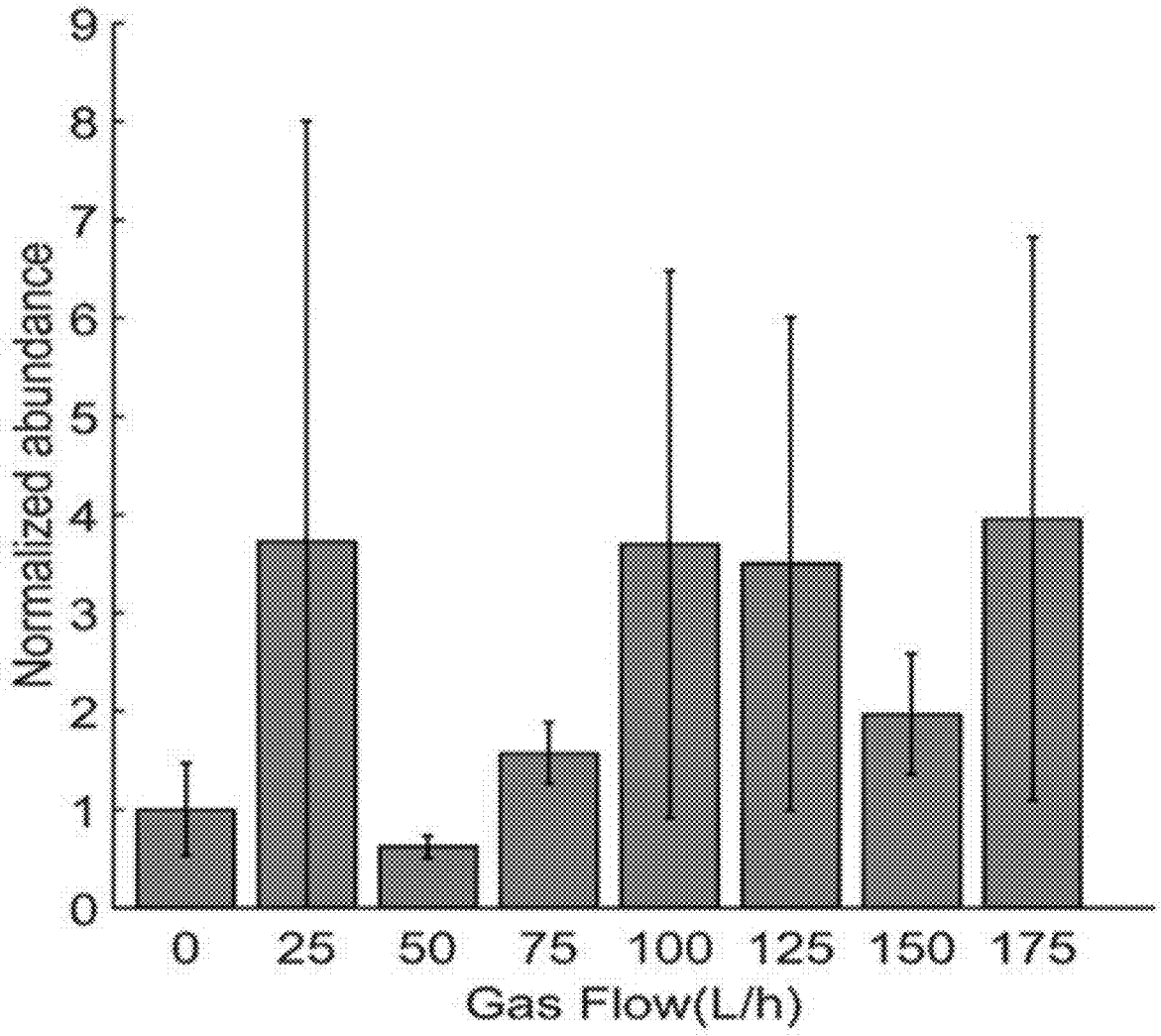
FIG. 17 shows an example of the normalized total ion abundance from an ion sample as a function of the gas flow through the gas confinement device. The abundance at zero gas flow is normalized to 1.

To investigate the extent to which the transfer efficiency can be increased with a biological sample, an onion skin sample was placed in the center of the gas confinement device and moved manually in order to keep it centered within the device. The ion signal as a function of gas flow was investigated (FIG. 17) and an optimum value of 125 L/h resulted in an increase in the total ion abundance of 3.5±2.5.

Figure 18:
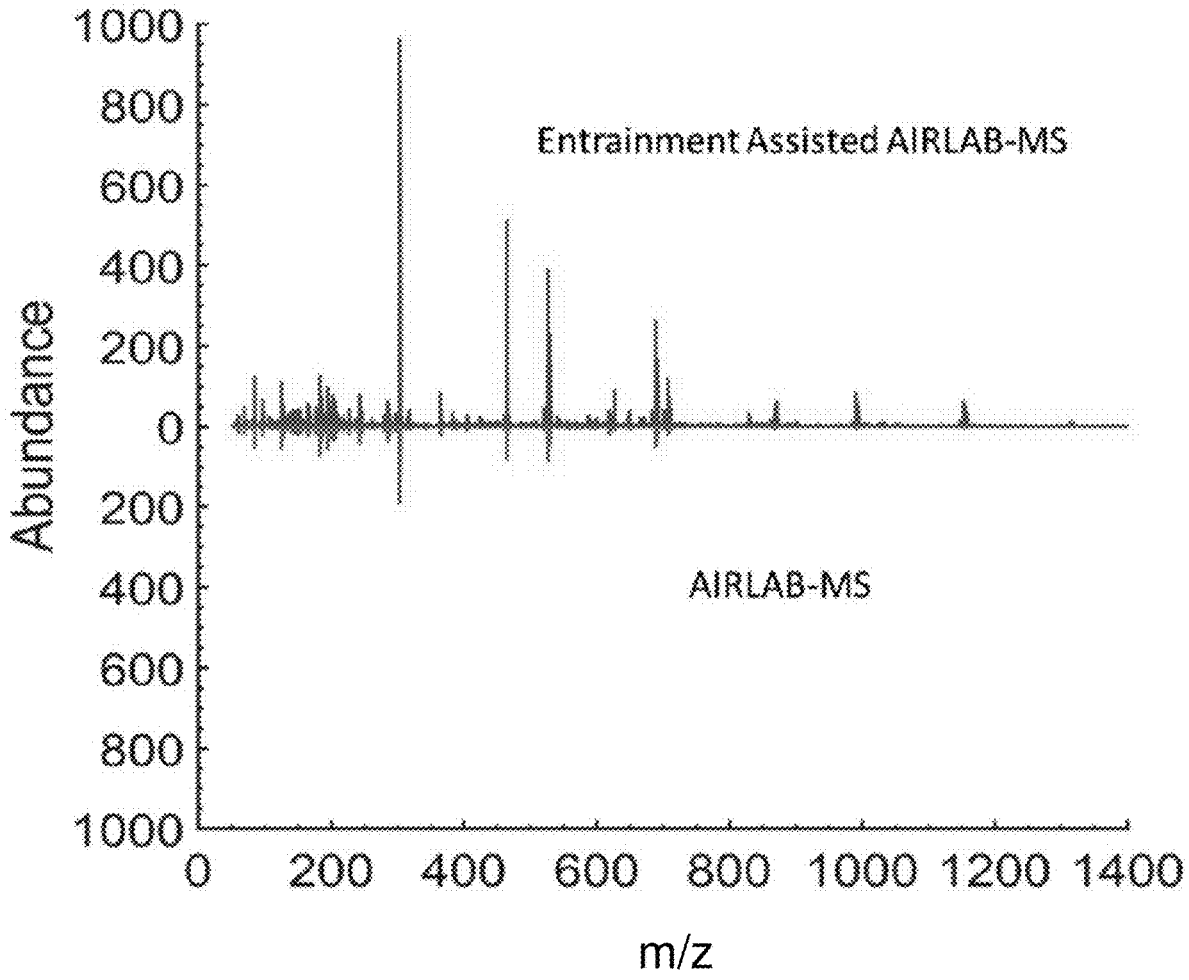
FIG. 18 shows an example of mass spectra of onion cell for two different gas flow through the gas confinement device, 0 for the lower plot and 125 L/h for the upper plot. Each sample was ablated with 20 laser pulses, and each experiment was repeated five times.
Figure 19:
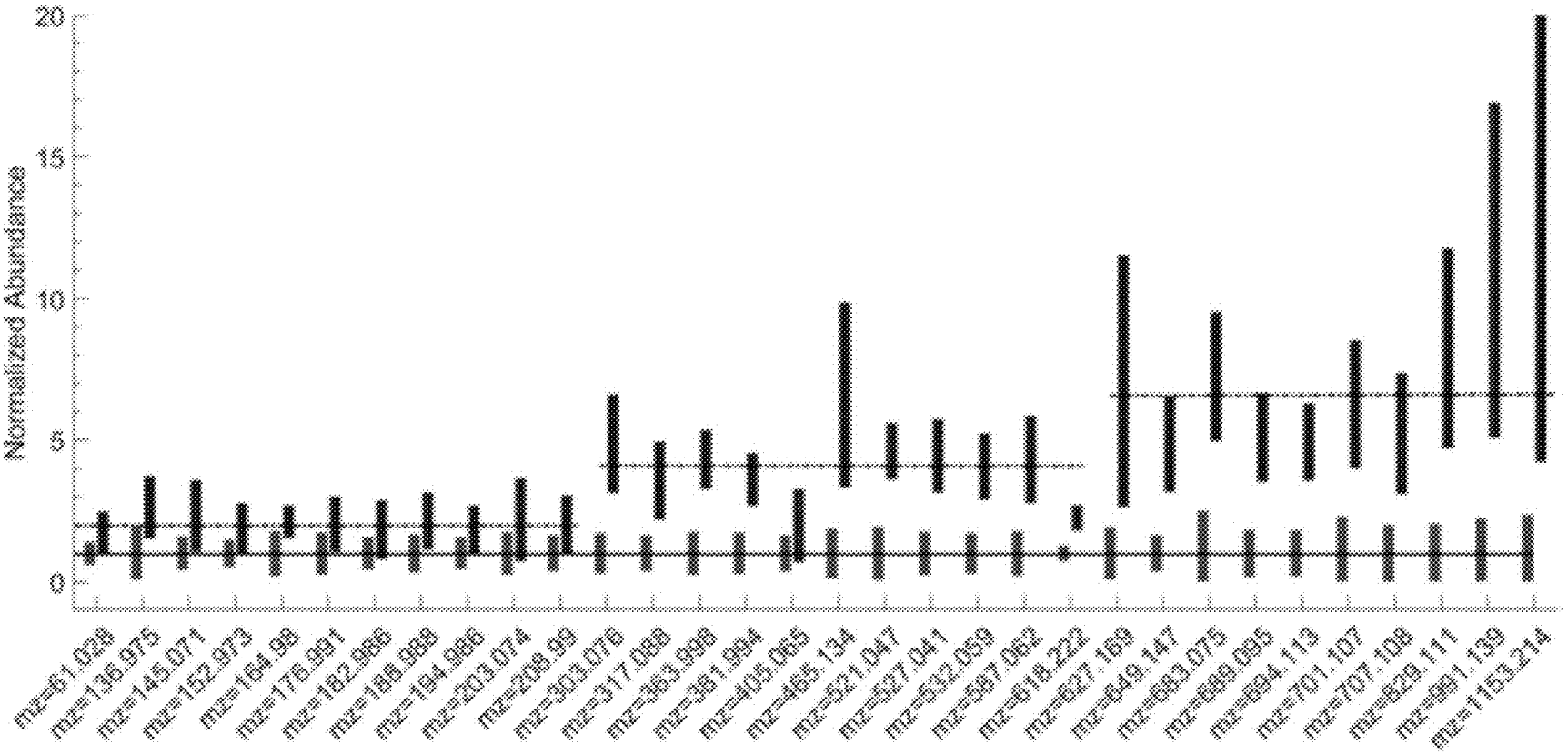
FIG. 19 shows an example of the variation of selected masses in the onion mass spectra (FIG. 18) for the gas flow of 0 L/h in the lower plot and 125 L/h in the upper plot. The signal for each mass at zero gas flow is normalized to 1. The horizontal lines represent the average values for 3 different group of masses: (1) m/z=61 to 203 0 L/h: 1±0.64, 125 L/h: 2.07±1; (2) m/z=303 to 465 0 L/h: 1±0.71 125 L/h: 3.9±1.5; (3) m/z=618 to 1153 0 L/h: 1±1 125 L/h: 6.8±3. A maximum of 12±8 was measured for m/z=1153.2.

However, the extent of signal enhancement depends on the ion m/z (FIG. 18). There is little gain in ion signal for ions below m/z 200, whereas higher m/z ions are significantly enhanced by the gas flow. To investigate the mass dependent enhancement of signal more quantitatively, abundances of ions between m/z=61 and 220, 303 to 465 and 618-1153 (FIG. 19) were summed. These results show that there is a net enhancement compared to no gas flow for these m/z ranges of 2±1, 4±1.5 and 7±3, respectively. Within uncertainty, there is no significant gain in signal for the lower mass ions, but there is up to a seven-fold gain for higher mass ions. The origin of the mass dependent signal enhancement is not clear, but smaller mass ions may be more susceptible to loss near the surface where gas flow is minimal.

CONCLUSION

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A system comprising:
- a microscope;
- a laser, the laser being positioned to emit light through an objective lens of the microscope;
- a continuous flow probe coupled to a spectrometer, an end of the continuous flow probe positioned proximate a sample and between the sample and the objective lens; and
- a gas confinement device, the gas confinement device defining:
  - a gas inlet,
  - a chamber, the chamber being in fluid communication with the gas inlet,
  - a platform, the platform operable to support a sample, the platform being outside of the chamber,
  - a plurality of vents, each of the plurality of vents being positioned to direct a gas substantially parallel to the platform, and
  - a plurality of channels, the plurality of channels operable to provide fluid communication between the chamber and the plurality of vents.

2. The system of claim 1, wherein each of the plurality of vents are defined in a wall surrounding the platform, wherein the plurality of vents are symmetrically arranged around the platform, and wherein the symmetrical arrangement is substantially circular.

3. The system of claim 1, wherein each of the plurality of vents is positioned about 0.25 millimeters to 0.75 millimeters above the platform.

4. The system of claim 1, wherein each of the plurality of vents comprises an approximately cylindrical vent.

5. The system of claim 4, wherein a diameter of each of the approximately cylindrical vents is about 0.75 millimeters to 1.25 millimeters.

6. The system of claim 1, wherein the plurality of vents comprises at least 10 vents.

7. The system of claim 1, further comprising:
- an optical imaging system operable to image a solvent droplet at the end of continuous flow probe, and wherein the optical imaging system includes a proportional-integral-derivative feedback system operable to control a size of the solvent droplet.

8. The system of claim 7, wherein the proportional-integral-derivative feedback system is operable to control a flow rate of a pump that provides solvent to the solvent droplet.

9. A system comprising:
- a microscope;
- a laser, the laser being positioned to emit light through an objective lens of the microscope;
- a continuous flow probe coupled to a spectrometer, an end of the continuous flow probe positioned proximate a sample and between the sample and the objective lens; and
- a gas confinement device, the gas confinement device defining:
  - a gas inlet,
  - a chamber, the chamber being in fluid communication with the gas inlet,
  - a platform, the platform being outside of the chamber,
  - a wall surrounding the platform, the wall defining a first notch and a second notch operable to allow a sample holder to be positioned at a center of the platform,
  - a plurality of vents, each of the plurality of vents being positioned to direct a gas substantially parallel to the platform, each of the plurality of vents being defined in the wall, and
  - a plurality of channels, the plurality of channels operable to provide fluid communication between the chamber and the plurality of vents.

10. The system of claim 9, wherein the plurality of vents are symmetrically arranged around the platform, and wherein the symmetrical arrangement is substantially circular.

11. The system of claim 9, wherein the plurality of vents comprises two slits, and wherein a plane of each slit is substantially parallel to the sample platform.

12. The system of claim 9, wherein each of the plurality of vents is positioned about 0.25 millimeters to 0.75 millimeters above the platform.

13. The system of claim 9, wherein each of the plurality of vents comprises an approximately cylindrical vent.

14. The system of claim 9, wherein the plurality of vents comprises at least 10 vents.

15. The system of claim 9, further comprising:

an optical imaging system operable to image a solvent droplet at the end of continuous flow probe, and wherein the optical imaging system includes a proportional-integral-derivative feedback system operable to control a size of the solvent droplet.

16. The system of claim 15, wherein the proportional-integral-derivative feedback system is operable to control a flow rate of a pump that provides solvent to the solvent droplet.

17. A system comprising:

a microscope;

a laser, the laser being positioned to emit light through an objective lens of the microscope;

a continuous flow probe coupled to a spectrometer, an end of the continuous flow probe positioned proximate a sample and between the sample and the objective lens;

an optical imaging system operable to image a solvent droplet at the end of continuous flow probe, the optical imaging system including a proportional-integral-derivative feedback system operable to control a size of the solvent droplet; and a platform operable to hold the sample to be subjected to laser ablation.

18. The system of claim 17, wherein the optical imaging system includes an imaging laser and a camera.

19. The system of claim 17, wherein the proportional-integral-derivative feedback system is operable to control the flow rate of a pump that provides solvent to the solvent droplet.

20. The system of claim 19, wherein the pump comprises a syringe pump.

* * * * *